US009428306B2

(12) United States Patent
Turvey et al.

(10) Patent No.: US 9,428,306 B2
(45) **Date of Patent: *Aug. 30, 2016**

(54) GASTIGHT VALVE STRIP FOR A RECLOSABLE CONTAINER

(71) Applicant: S.C. Johnson & Son, Inc., Racine, WI (US)

(72) Inventors: Robert R. Turvey, Sanford, MI (US); Razili Stanke-Koch, Pleasant Ridge, MI (US)

(73) Assignee: S.C. Johnson & Son, Inc., Racine, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/620,268

(22) Filed: Feb. 12, 2015

(65) Prior Publication Data

US 2015/0151883 A1 Jun. 4, 2015

Related U.S. Application Data

(60) Continuation of application No. 13/471,576, filed on May 15, 2012, now Pat. No. 8,985,855, which is a division of application No. 12/383,127, filed on Mar. 20, 2009, now Pat. No. 8,197,139, which is a continuation-in-part of application No. 11/818,591, filed on Jun. 15, 2007, now Pat. No. 7,874,731.

(51) Int. Cl.

| | |
|---|---|
| ***B65D 33/01*** | (2006.01) |
| ***B65D 33/16*** | (2006.01) |
| ***B65D 33/25*** | (2006.01) |
| ***B65D 77/22*** | (2006.01) |

(Continued)

(52) U.S. Cl.

CPC ..... *B65D 33/1691* (2013.01); *B65D 33/2508* (2013.01); *B65D 33/30* (2013.01); *B65D 77/225* (2013.01); *B65D 81/2015* (2013.01); *B65D 81/2023* (2013.01); *B65D 81/2038* (2013.01)

(58) Field of Classification Search

CPC ..... B65D 33/2508; B65D 77/225; B65D 81/2015; B65D 81/2023; B65D 81/2038

USPC ..... 383/103

See application file for complete search history.

(56) References Cited

U.S. PATENT DOCUMENTS

| | | | |
|---|---|---|---|
| 2,870,954 | A | 1/1959 | Kulesza |
| 3,026,656 | A | 3/1962 | Rumsey, Jr. |
| 3,874,963 | A | 4/1975 | Barger |

(Continued)

FOREIGN PATENT DOCUMENTS

| | | | |
|---|---|---|---|
| DE | 2549855 | A1 | 9/1977 |
| DE | 3521373 | A1 | 12/1986 |

*Primary Examiner* — Jes F Pascua

(57) ABSTRACT

A gastight valve strip for a reclosable container includes first and second film layers adapted to be disposed over an aperture through a sidewall of a reclosable container. The second film layer opposes the first and includes an attachment surface adapted to be sealed to the sidewall of the container. The attachment surface has a patterned portion that defines a region of flow channels. Opposing surfaces of the first and second film layers form a substantially gastight seal therebetween upon contact of the first and second film layers to each other. A first film layer aperture extends through the first film layer, and is in fluid communication with an exterior side of the valve strip. A second film layer aperture extends through the second film layer, is offset and spaced apart from the first film layer aperture, and is in fluid communication with the container aperture through the patterned portion.

18 Claims, 15 Drawing Sheets

(51) Int. Cl.
*B65D 81/20* (2006.01)
*B65D 33/30* (2006.01)

(56) References Cited

U.S. PATENT DOCUMENTS

| | | | |
|---|---|---|---|
| 4,373,979 | A | 2/1983 | Planeta |
| 4,374,697 | A | 2/1983 | Tsuzuki et al. |
| 4,741,789 | A | 5/1988 | Zieke et al. |
| 4,755,248 | A | 7/1988 | Geiger et al. |
| 4,927,474 | A | 5/1990 | Pawloski |
| 4,953,550 | A | 9/1990 | Dunshee |
| 5,012,561 | A | 5/1991 | Porchia et al. |
| 5,070,584 | A | 12/1991 | Dais et al. |
| 5,478,228 | A | 12/1995 | Dais et al. |
| 5,492,705 | A | 2/1996 | Porchia et al. |
| 5,553,942 | A | 9/1996 | Domke et al. |
| 5,554,250 | A | 9/1996 | Dais et al. |
| 5,584,409 | A | 12/1996 | Chemberlen |
| 5,655,273 | A | 8/1997 | Tomic et al. |
| 5,689,866 | A | 11/1997 | Kasai et al. |
| 5,779,832 | A | 7/1998 | Kocher |
| 5,989,608 | A | 11/1999 | Mizuno |
| 6,021,557 | A | 2/2000 | Dais et al. |
| 6,032,827 | A | 3/2000 | Zettle et al. |
| 6,182,850 | B1 | 2/2001 | Marbler et al. |
| 6,185,796 | B1 | 2/2001 | Ausnit |
| 6,835,257 | B2 | 12/2004 | Perrine |
| 6,954,969 | B1 | 10/2005 | Sprehe |
| 7,004,632 | B2 | 2/2006 | Hamilton et al. |
| 7,041,249 | B2 | 5/2006 | Wright et al. |
| 7,063,231 | B2 | 6/2006 | Stanos et al. |
| 7,137,736 | B2 | 11/2006 | Pawloski et al. |
| 7,137,738 | B2 | 11/2006 | Shah et al. |
| 7,178,555 | B2 | 2/2007 | Engel et al. |
| 7,220,476 | B2 | 5/2007 | Sperry et al. |
| 7,244,223 | B2 | 7/2007 | Hartman et al. |
| 7,290,660 | B2 | 11/2007 | Tilman et al. |
| 7,305,742 | B2 | 12/2007 | Anderson |
| 7,410,298 | B2 | 8/2008 | Pawloski |
| 7,527,585 | B2 | 5/2009 | Anzini et al. |
| 7,726,880 | B2 | 6/2010 | Zimmerman et al. |
| 7,784,160 | B2 | 8/2010 | Dais et al. |
| 7,798,713 | B2 | 9/2010 | Blythe et al. |
| 7,837,387 | B2 | 11/2010 | Newrones et al. |
| 7,857,515 | B2 | 12/2010 | Dais et al. |
| 7,874,731 | B2 | 1/2011 | Turvey et al. |
| 7,886,412 | B2 | 2/2011 | Dais et al. |
| 7,946,766 | B2 | 5/2011 | Dais et al. |
| 7,967,509 | B2 | 6/2011 | Turvey et al. |
| 8,096,329 | B2 | 1/2012 | Thuot et al. |
| 8,192,182 | B2 | 6/2012 | LeBoeuf et al. |
| 8,197,138 | B2 | 6/2012 | Turvey |
| 8,197,139 | B2 | 6/2012 | Turvey et al. |
| 8,439,063 | B2 | 5/2013 | Seline et al. |
| 8,530,676 | B2 | 9/2013 | Langer et al. |
| 8,985,855 | B2 * | 3/2015 | Turvey ..... B65D 33/2508 383/103 |
| 2002/0022114 | A1 | 2/2002 | Sorensen et al. |
| 2004/0091179 | A1 | 5/2004 | Anderson |
| 2004/0223667 | A1 | 11/2004 | Shah et al. |
| 2004/0234172 | A1 | 11/2004 | Pawloski |
| 2005/0286808 | A1 | 12/2005 | Zimmerman et al. |
| 2006/0030472 | A1 | 2/2006 | Hartman et al. |
| 2006/0093242 | A1 | 5/2006 | Anzini et al. |
| 2006/0111226 | A1 | 5/2006 | Anzini et al. |
| 2006/0228057 | A1 | 10/2006 | Newrones et al. |
| 2007/0110343 | A1 | 5/2007 | Buchman et al. |
| 2007/0263948 | A1 | 11/2007 | Buchman et al. |
| 2008/0144979 | A1 | 6/2008 | Capt et al. |
| 2009/0123094 | A1 | 5/2009 | Kreymborg et al. |
| 2009/0175747 | A1 | 7/2009 | LeBoeuf et al. |
| 2009/0324141 | A1 | 12/2009 | Dais et al. |

* cited by examiner

GASTIGHT VALVE STRIP FOR A RECLOSABLE CONTAINER

CROSS REFERENCE TO RELATED APPLICATIONS

This application is a continuation application of copending U.S. patent application Ser. No. 13/471,576, filed May 15, 2012, which is a divisional of U.S. patent application Ser. No. 12/383,127, filed Mar. 20, 2009, now U.S. Pat. No. 8,197,139, issued Jun. 12, 2012, which is a continuation-in-part of application Ser. No. 11/818,591, filed Jun. 15, 2007, now U.S. Pat. No. 7,874,731, issued on Jan. 25, 2011, which are incorporated by reference herein in their entirety.

REFERENCE REGARDING FEDERALLY SPONSORED RESEARCH OR DEVELOPMENT

Not applicable.

SEQUENTIAL LISTING

Not applicable.

BACKGROUND OF THE INVENTION

1. Field of the Invention

The present invention relates generally to a gastight valve strip that may be used on a reclosable container.

2. Description of the Background of the Invention

Food or other perishables are often stored in reclosable containers such as thermoplastic pouches. To keep food stored inside a pouch fresh for an extended period, a user may evacuate gas out of the pouch before completely sealing a closure mechanism of the pouch. Other reclosable pouches have been developed that have a valve that allows gas to be evacuated from the pouch after the closure mechanism has already been sealed.

Some pouch valves have a patch of thermoplastic material covering an aperture in a pouch wall and sealed over a limited area of the pouch wall around a periphery of the patch. The patch has an aperture therethrough that is offset from the aperture in the pouch wall. Pressure from outside of the pouch forces the patch against the pouch wall, keeping the valve closed. However, pressure from within the pouch forces the patch to separate from the pouch wall to allow air to flow through both apertures and out of the pouch. Another valve has a highly cohesive fluid in the space between the offset apertures to resist separation of the patch and the pouch wall. Still another valve has a porous layer of material secured over the aperture in the pouch wall, wherein the porous layer has a smaller area than the patch.

Other valves have a cover flap disposed over an aperture in a pouch wall, wherein the cover flap lacks an aperture. The valves have an unsealed edge that provides a path for escaping air. One such valve has a separator layer disposed between an adhesive layer disposed on an inner surface of the cover flap and an aperture in the pouch wall. The separator layer is smaller than the cover flap, but larger than the aperture, and is shaped so that the adhesive layer makes asymmetrical contact with the pouch wall around a periphery of the cover flap. Pressure from within the pouch forces a portion of the cover flap having a smaller adhesive contact area to separate from the pouch wall. The valve may also have an intermediate gas permeable layer between the separator layer and the aperture.

Another valve has a cover flap that is disposed across an entire width of a pouch wall. The flap overlays one or more apertures in the pouch wall to allow air to escape from within the pouch and to prevent air from entering the pouch.

Yet another valve for a pouch has a patch that is disposed across an entire width of a pouch wall and is sealed to the pouch wall around a periphery of the patch. A first plurality of apertures extending through the pouch wall is offset from a second plurality of apertures extending through the patch. An adhesive is disposed between the first and second pluralities of apertures. Pressure from within the pouch overcomes the adhesive and forces the patch to separate from the pouch wall to allow air to escape from within the pouch.

A still further valve has a patch that is sealed around a periphery of the valve over an inner or outer surface of a plastic tube. The patch may be oriented axially along a length of the tube, or circumferentially around the tube. The patch has a vent opening that is offset from a vent opening through the tube surface. A vent seal zone is defined between the patch and the tube surface. The tube is sealed on both ends such that pressure from within the tube forces the patch to separate from the tube surface to allow air to escape from within the tube.

Yet another valve has first and second zipper flanges sealed to an inside surface of a pouch wall. A line of apertures is disposed through the pouch wall, wherein the first zipper flange is attached to the pouch wall on a first side of the apertures and the second zipper flange is attached to the pouch wall on a second, opposite side of the apertures. An air path is formed between the first and second zipper flanges and the apertures. Pressure from within the pouch forces the second flange away from the first flange and pressure from outside the pouch forces the second flange into contact with the first flange. Alternatively, the second flange is eliminated, and the pouch wall on the second side of the line of apertures makes contact with the first flange. In another variation, one or more apertures disposed through the first flange are covered in flap fashion by the second flange.

Multiple layers of film material may be joined together, for example, by ultrasonic vibration, heat sealing, an adhesive, or by other means, as known to one skilled in the art, to form gastight sealed regions between the multiple layers. In one instance, multiple layers of film are bonded together by an intermittent ultrasonic bond. The intermittent bond has a number of bond points, spaced close together along a line to provide a leak-proof seal between the layers. Material displaced from each of the bond points may make contact with or may be close enough to material displaced from an adjacent bond point to block passage of fluid therebetween.

Sealed regions between multiple layers of film material may be formed by application of an adhesive between the layers. Adhesives generally provide an enduring gastight seal, but environmental conditions may cause the gastight seal to degrade. For example, an adhesive may suffer from loss of tact in cold conditions, or may become excessively fluid in hot or microwave conditions, resulting in flow of the adhesive into areas of the container where the adhesive may not be intended to go, such as into contact with food. A thermal seal may be more resistant than an adhesive seal to degradation caused by environmental conditions. A thermal seal between multiple layers of film material may be created by application of energy in the form of heat and/or ultrasonic vibration to a target sealing region. The applied energy may cause material within the target region to become molten, and to thereby bond the layers in a gastight seal. However, the molten material may flow away from the target region, and cause expansion and/or shrinkage of the film material surrounding the target region, which may form wrinkles in one or more layers of the film material outside of the target region.

SUMMARY OF THE INVENTION

According to one aspect, the present invention provides a gastight valve strip for a reclosable container. The reclosable container has a container aperture through a sidewall of the container. The valve strip includes a first film layer having a periphery, a second film layer opposing the first film layer and being attached to the first film layer, the first and second film layers adapted to be disposed over a container aperture through a sidewall of the reclosable container, the second film layer comprising an attachment surface being adapted to be sealed to the sidewall of the reclosable container, the attachment surface comprising a patterned portion that defines a region of flow channels, wherein opposing surfaces of the first and second film layers form a substantially gastight seal therebetween upon contact of the first and second film layers to each other, a first film layer aperture extending through the first film layer, the first film layer aperture being in fluid communication with an exterior side of the valve strip, and a second film layer aperture extending through the second film layer, the second film layer aperture being offset and spaced apart from the first film layer aperture, wherein the second film layer aperture is configured to be in fluid communication with the container aperture through the patterned portion of the attachment surface, the patterned portion extending along the attachment surface and into the second film layer aperture, in which at least a portion of a surface of the second film layer opposite to the attachment surface comprises a patterned portion to provide flow channels in fluid communication with the second film layer aperture, such that a vacuum pressure dispersed over the first film layer aperture and the flow channels separates the first film layer and the second film layer, to allow gas to exhaust from the reclosable container through the container aperture.

BRIEF DESCRIPTION OF THE DRAWINGS

Other aspects and advantages of the present invention will become apparent upon consideration of the following detailed description, wherein similar structures have similar reference numerals.

DETAILED DESCRIPTION

While the present invention may be embodied in many forms, several embodiments are discussed herein, with the understanding that embodiments illustrated are to be considered only as an exemplification of the invention and are not intended to limit the disclosure to the embodiments illustrated. For example, while a reclosable pouch and a reclosable hard-walled container are shown, any other container, such as reclosable or non-reclosable, soft- or hard-walled, to which a valve can be applied to evacuate gas therefrom, can also be used with the present invention.

Figure 1:
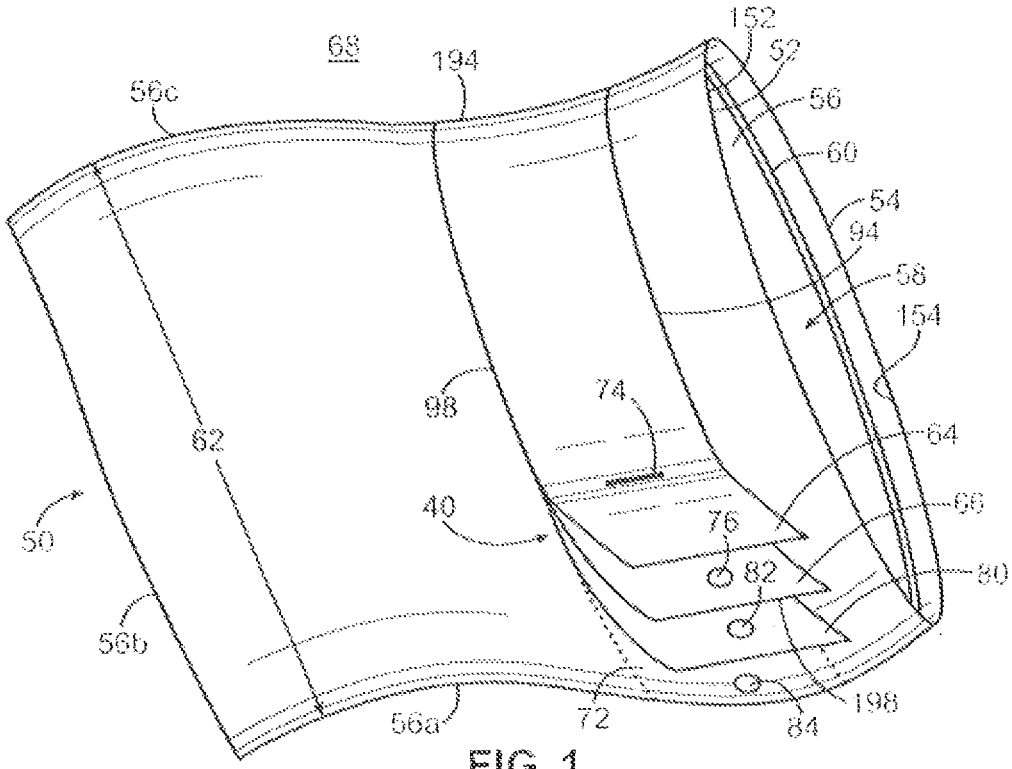
FIG. 1 is an isometric view of a reclosable pouch incorporating a valve and illustrating valve layers peeled up for clarity.

Turning now to the figures, a reclosable thermoplastic pouch 50, illustrated in FIG. 1, includes a first sidewall 52, a second sidewall 54, and a valve 40. The first and second sidewalls 52 and 54 are joined around the three side edges 56*a*-56*c* by heat sealing, adhesive, ultrasonic vibration, or other sealing method known in the art, to define an opening 56 leading to an interior 58. Alternatively, bottom side edge 56*b* may be a fold line between the first and second sidewalls 52 and 54. A closure mechanism 60 extends across a full width 62 of the pouch 50, proximate to the opening 56. The closure mechanism 60 allows the pouch 50 to be repeatedly opened and closed. When occluded, the closure mechanism 60 preferably provides a gastight seal, such that a vacuum may be maintained in the pouch interior 58 for a desired period of time, such as days, months, or years, when the closure mechanism is sealed fully across the opening 56.

The closure mechanism 60 comprises first and second complementary interlocking closure elements 200, 202 (illustratively shown in FIG. 12) that are disposed along the respective inner surfaces 152 and 154 of the first and second sidewalls 52 and 54. The first interlocking closure element 200 includes one or more interlocking closure profiles 200*a* (illustratively shown in FIG. 12), and the second interlocking closure element 202 also includes one or more interlocking closure profiles 202*a* (illustratively shown in FIG. 12). The first and second interlocking closure profiles 200*a*, 202*a* may be male and female closure profiles, respectively, as shown. However, the configuration and geometry of the interlocking profiles 200*a*, 202*a* or closure elements 200, 202 disclosed herein may vary.

In a further embodiment, one or both of the first and second complementary interlocking closure elements 200, 202 may include one or more textured portions, such as a bump or crosswise groove in one or more of the first and second closure profiles 200*a*, 202*a* in order to provide a tactile sensation, such as a series of clicks, as a user draws the fingers along the closure mechanism 60 to seal the closure elements across the opening. In another embodiment, the first and second interlocking closure profiles 200*a*, 202*a* include textured portions along the length of each profile to provide tactile and/or audible sensations when closing the closure mechanism 60. In addition, protuberances, for example, ridges (not shown), may be disposed on the inner surfaces 152, 154 of the respective first and second sidewalls 52, 54, proximate to the opening 56, to provide increased traction in a convenient area for a user to grip, such as a gripping flange, when trying to open the sealed pouch 60.

Further, in some embodiments, a sealing material, such as a polyolefin material or a caulking composition, such as silicone grease, may be disposed on or in the interlocking profiles 200*a*, 202*a* or closure elements 200, 202, to fill in any gaps or spaces therein when occluded. The ends of the interlocking profiles 200*a*, 202*a* or closure elements 200, 202 may also be welded or sealed to provide an end-stomp seal between the first and second closure elements 200, 202 by, for example, crushing, ultrasonic vibration, and/or application of heat, as is known in the art. Illustrative interlocking profiles, closure elements, sealing materials, tactile or audible closure elements, and/or end-stomps useful in the present invention include those disclosed in, for example, Pawloski U.S. Pat. No. 4,927,474, Dais et al. U.S. Pat. Nos. 5,070,584, 5,478,228, and 6,021,557, Tomic et al. U.S. Pat. No. 5,655,273, Sprehe U.S. Pat. No. 6,954,969, Kasai et al. U.S. Pat. No. 5,689,866, Ausnit U.S. Pat. No. 6,185,796, Wright et al. U.S. Pat. No. 7,041,249, Pawloski et al. U.S. Pat. No. 7,137,736, Tilman et al. U.S. Pat. No. 7,290,660, Anderson U.S. Patent Application Publication No. 2004/0091179, now U.S. Pat. No. 7,305,742, Pawloski U.S. Patent Application Publication No. 2004/0234172, now U.S. Pat. No. 7,410,298, and Anzini et al. U.S. Patent Application Publication No. 2006/0093242 and No. 2006/0111226, now U.S. Pat. No. 7,527,585. Other interlocking profiles and closure elements useful in the present invention include those disclosed in, for example, U.S. patent application Ser. No. 11/725,120, filed Mar. 16, 2007, now U.S. Pat. No. 7,886,412, U.S. patent application Ser. No. 11/818,585, now U.S. Pat. No. 7,857,515, Ser. No. 11/818,593, now U.S. Pat. No. 7,784,160, and Ser. No. 11/818,586, now U.S. Pat. No. 7,946,766, each filed on Jun. 15, 2007, and U.S. patent application Ser. No. 12/146,015, filed on Jun. 25, 2008, which was published as U.S. Patent Application Publication No. 2009/0324141 on Dec. 31, 2009, now U.S. Pat. No. 8,530,676. It is further appreciated that the interlocking profiles or closure elements disclosed herein may be operated by hand, or a slider (not shown) may be used to assist in occluding and de-occluding the interlocking profiles and closure elements.

The resealable pouch described herein can be made by various techniques known to those skilled in the art, including those described in, for example, Geiger, et al., U.S. Pat. No. 4,755,248. Other useful techniques to make a resealable pouch include those described in, for example, Zieke et al., U.S. Pat. No. 4,741,789. Additional techniques to make a resealable pouch include those described in, for example, Porchia et al., U.S. Pat. No. 5,012,561. Additional examples of making a resealable pouch as described herein include, for example, a cast post applied process, a cast integral process, and/or a blown process.

A first layer 64 of a film material may be disposed on the first sidewall 52. A second layer 66 of film material may also be disposed on the first sidewall 52 between the first sidewall and the first layer 64. Each of the first and second layer 64, 66 may be disposed on a portion of the first sidewall 52, or across the full width 62 of the first sidewall 52, as illustrated in FIG. 1. Further, each of the first and second layer 64 and 66 may be comprised of one or more plies of material. An exterior 68 of the pouch 50 is also shown in FIG. 1.

Figure 2:
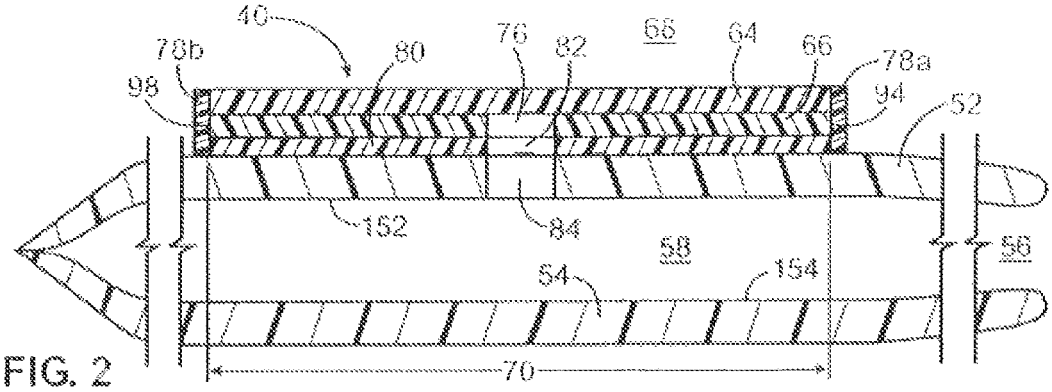
FIG. 2 is a fragmentary cross-sectional view of an embodiment of a valve taken generally along the lines 2-2 of FIG. 1A, with portions behind the plane of the cross section omitted for clarity.

Referring next to an embodiment of the valve 40, as seen in FIG. 2, the second layer 66 has an overlap region 70 that overlaps the first sidewall 52. The overlap region 70 comprises the entire second layer 66. A projection 72 of the overlap region 70 of the second layer 66 is shown by the area outlined by the dashed lines in FIG. 1.

Figure 6:
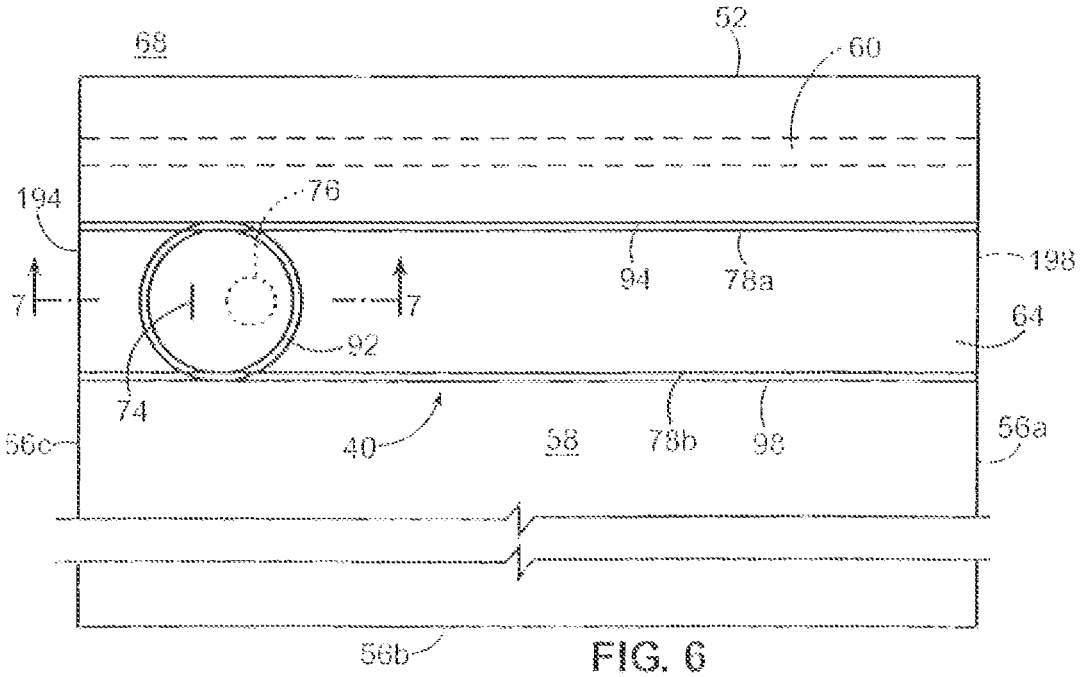
FIG. 6 is a fragmentary plan view of a first sidewall of a pouch illustrating a further embodiment of a valve.
Figure 6A:
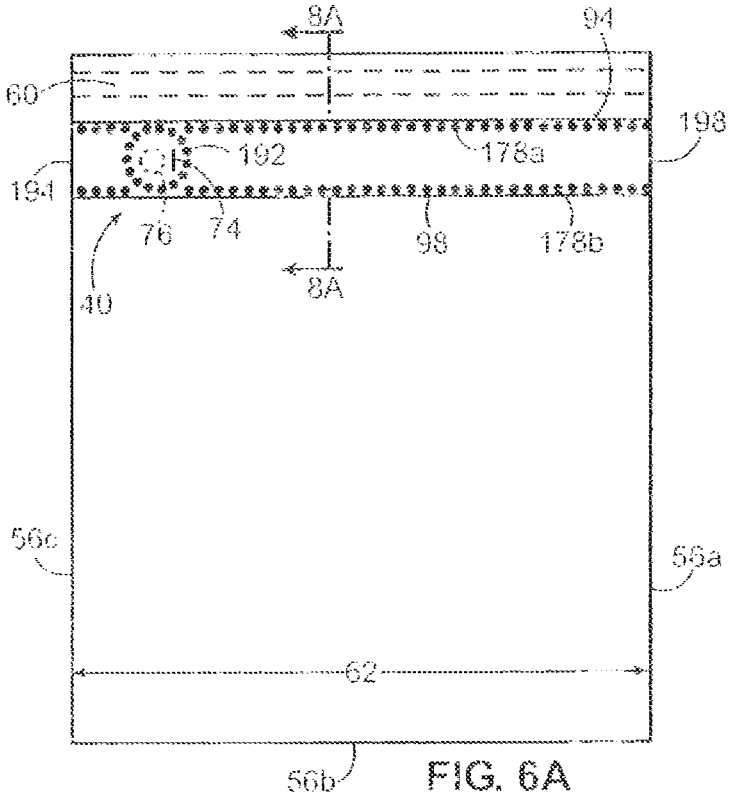
FIG. 6A is a plan view of a first sidewall of a pouch illustrating a still further embodiment of a valve.

Referring now to FIGS. 1 and 2, a first aperture 74 extends through the first layer 64 and a second aperture 76 extends through the second layer 66. The first layer 64 is attached to the second layer 66 at a portion of the second layer. Illustratively, the first layer 64 is attached to the second layer 66 around the entire periphery of the second layer, or along one or more peripheral edges 94, 98, 194, 198 of the second layer. The first and second layers 64 and 66 are attached to each other by a thermal seal 78*a* along the peripheral edge 94 and by a thermal seal 78*b* along the peripheral edge 98. The thermal seals 78*a*, 78*b* may be continuous, as shown in FIG. 6, or may be intermittent spot seals 178*a*, 178*b*, as shown in FIG. 6A. Each of the thermal seals 78*a*, 78*b*, 178*a*, 178*b* may be a heat seal, a seal created by ultrasonic vibration, or some other thermal seal as is known in the art.

The second layer 66 is sealed to the first sidewall 52 at a periphery of the overlap region 70 of the second layer 66, including, for example, around a periphery of the overlap region or on at least a portion of the overlap region. In the embodiment of FIG. 2, a thermoplastic weld layer 80 is disposed coextensively with the second layer 66 between the sidewall 52 and the second layer 66 to seal the entire second layer 66 to the first sidewall 52. The thermoplastic weld layer 80 may be composed of any suitable thermoplastic material, such as, for example, polypropylene.

A third aperture 82 extends through the thermoplastic weld layer 80 and a fourth aperture 84 extends through the first sidewall 52, as illustrated in FIG. 2. The second, third, and fourth apertures, 76, 82, and 84 are arranged to be coincident along a line perpendicular to the sidewall 52, to allow fluid communication of the second aperture 76 with the interior 58 of the pouch 50. The first aperture 74 in the first layer 64 is in fluid communication with the exterior 68 of the pouch 50.

Figure 1A:
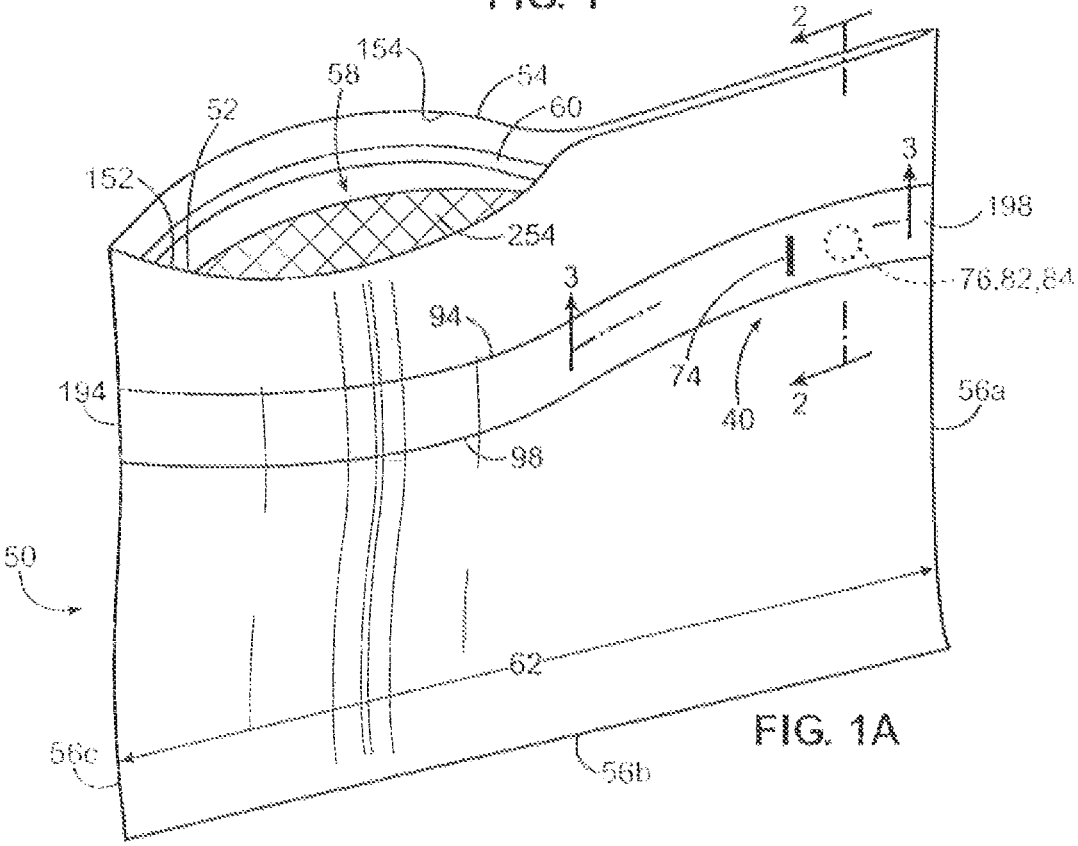
FIG. 1A is an isometric view of a reclosable pouch illustrating a textured pattern on a sidewall.
Figure 4:
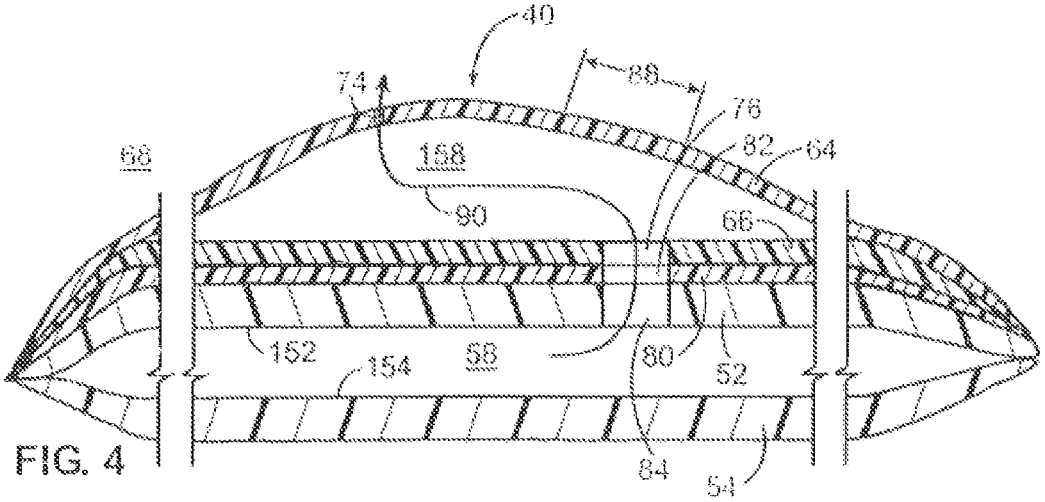
FIG. 4 is a fragmentary cross-sectional view taken generally along the lines 3-3 of FIG. 1A, with the first and second layers of the valve of the first embodiment separated and with portions behind with the plane of the cross section omitted for clarity.
Figure 4A:
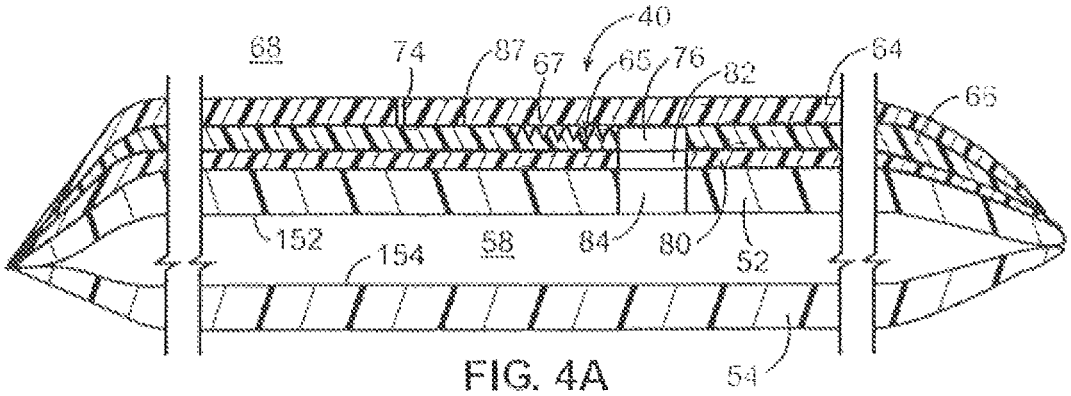
FIG. 4A is a fragmentary cross-sectional view of another embodiment of a valve taken generally along the lines 3-3 of FIG. 1A, with portions behind the plane of the cross section omitted for clarity.
Figure 4B:
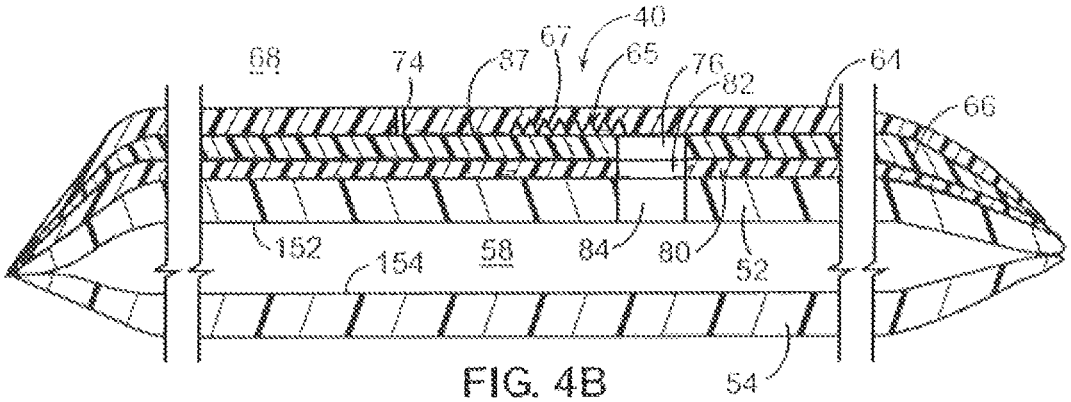
FIG. 4B is a fragmentary cross-sectional view of a further embodiment of a valve taken generally along the lines 3-3 of FIG. 1A, with portions behind the plane of the cross section omitted for clarity.
Figure 4C:
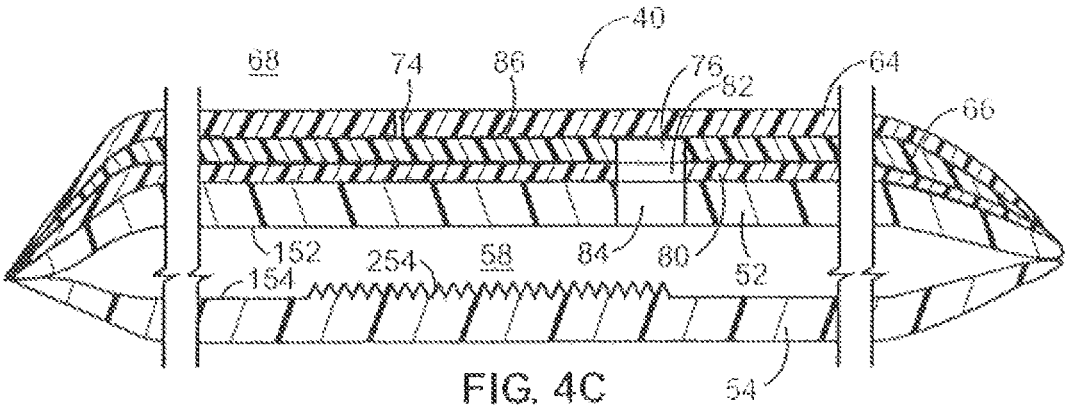
FIG. 4C is a fragmentary cross-sectional view of the valve of FIG. 3 illustrating embossing on an interior surface of a pouch sidewall, with portions behind the plane of the cross section omitted for clarity.

One or both sidewalls, such as the second sidewall 54, may also be embossed or otherwise textured with a pattern 254, as illustrated in FIGS. 1A and 4C. One or both surfaces of the second sidewall 54, for example, the inner surface 154, may be embossed or textured between the bottom side edge 56*b* and the closure mechanism 60, or a separate textured or embossed patterned wall may be used to provide flow channels (not shown) within the pouch interior 58. In one embodiment, the second sidewall 54 is embossed with a diamond pattern 254, for example, as shown in FIGS. 1A and 4C, wherein the pattern extends from just beneath the closure mechanism 60 to the bottom side edge 56*b* and opposes the second aperture 76 that is in fluid communication with the interior 58 of the pouch 50. The flow channels may provide fluid communication between the pouch interior 58 and the valve 40 when gas is being drawn through the valve 40. Illustrative flow channels useful in the present invention include those disclosed in Zimmerman et al. U.S. Patent Application Publication No. 2005/0286808, now U.S. Pat. No. 7,726,880, and Tilman et al. U.S. Pat. No. 7,290,660. Other flow channels useful in the present invention include those disclosed in, for example, U.S. patent application Ser. No. 11/818,584, filed on Jun. 15, 2007, now U.S. Pat. No. 7,887,238.

Figure 3:
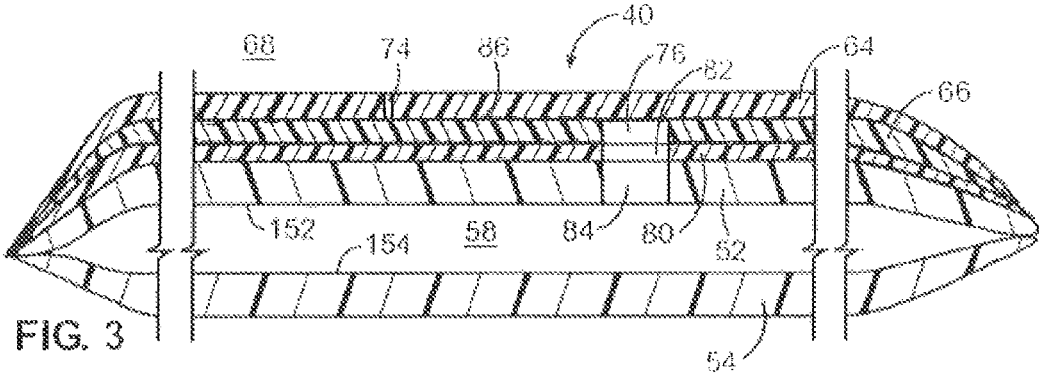
FIG. 3 is a fragmentary cross-sectional view taken generally along the lines 3-3 of FIG. 1A, with portions behind the plane of the cross section omitted for clarity.

Referring next to FIG. 3, the first aperture 74 is offset from the second, third, and fourth apertures 76, 82, and 84. The first and second layers 64 and 66 are in direct contact in an intermediate seal region 86 between the offset first and second apertures 74 and 76. Although the first and second apertures 74 and 76 are shown in FIG. 3 to be offset from one another along the width 62 of the pouch 50, in all of the embodiments described herein, the first and second apertures may be offset in any relative orientation that allows for direct contact of the first and second layers 64 and 66 in the intermediate seal region 86 between the first and second apertures. A substantially gastight seal is formed between the first and second layers 64 and 66 by direct contact of the first layer to the second layer.

In one embodiment, the first and second sidewalls 52, 54 and/or the closure mechanism 60 are formed from thermoplastic resins by known extrusion methods. For example, the sidewalls 52, 54 may be independently extruded of thermoplastic material as a single continuous or multi-ply web, and the closure mechanism 60 may be extruded of the same or different thermoplastic material(s) separately as continuous lengths or strands. Illustrative thermoplastic materials include polypropylene (PP), polyethylene (PE), metallocene-polyethylene (mPE), low density polyethylene (LDPE), linear low density polyethylene (LLDPE), ultra low density polyethylene (ULDPE), biaxially-oriented ppolyethylene terephthalate (BPET), high density polyethylen (HDPE), polyethylene terephthalate (PET), among other polyolefin plastomers and combinations and blends thereof. Further, the inner surfaces 152, 154 of the respective sidewalls 52, 54 or a portion or area thereof may, for example, be composed of a polyolefin plastomer such as an AFFINITY™ resin manufactured by Dow Plastics. Such portions or areas include, for example, the area of one or both of the sidewalls 52, 54 proximate to and parallel to the closure mechanism 60, to provide an additional cohesive seal between the sidewalls 52, 54 when the pouch 50 is evacuated. One or more of the sidewalls 52, 54 in other embodiments may also be formed of an air-impermeable film. An example of an air-impermeable film includes a film having one or more barrier layers, such as an ethylene-vinyl alcohol copolymer (EVOH) ply or a nylon ply, disposed between or on one or more of the plies of the sidewalls 52, 54. The barrier layer may be, for example, adhesively secured between the PP and/or LDPE plies to provide a multilayer film. Other additives, such as colorants, slip agents, and antioxidants, including, for example, talc, oleamide or hydroxyl hydrocinnamate, may also be added as desired. In another embodiment, the closure mechanism 60 may be extruded primarily of molten PE with various amounts of slip component, colorant, and/or talc additives in a separate process. The fully formed closure mechanism 60 may be attached to the pouch body using a strip of molten thermoplastic weld material, or by an adhesive known by those skilled in the art, for example. Other thermoplastic resins and air-impermeable films useful in the present invention include those disclosed in, for example, Tilman et al. U.S. Pat. No. 7,290,660.

With reference to FIG. 4, and not wishing to be bound by theory, the operation of the embodiment of FIGS. 2 and 3 will now be described, it being believed that the other embodiments discussed herein operate in a similar fashion. Gas pressure from the exterior 68 of the pouch 50 that is greater than or equal to a gas pressure of the interior 58 of the pouch 50 compresses the pouch 50 and forces the first and second layers 64 and 66 into contact with each other, thereby forming a substantially gastight seal. Further, an opening region 88 of the first layer 64 disposed directly over the second aperture 76, is subject to any pressure imbalance between the interior and exterior 58 and 68 of the pouch 50. Increased gas pressure from the interior 58 of the pouch 50 forces the opening region 88 of the first layer 64 away from the second layer 66 and, thereafter, a remainder of the first layer 64 is forced away from the second layer 66. Separation of the opening region 88 from the second aperture 76 allows higher pressure gas from within the interior 58 of the pouch 50 to spread away from the second aperture into a space 158 formed between the layers 64 and 66. An expanding zone of higher pressure gas applies a pressure imbalance to a corresponding expanding region of the first layer 64. When the expanding zone of higher pressure gas reaches the first aperture 74, the higher pressure gas escapes through the first aperture to the exterior 68 of the pouch 50. At this point, gas can escape freely from the interior 58 of the pouch 50 to the exterior 68 of the pouch following a path 90, as depicted by the curved line and arrow in FIG. 4.

The valve 40 provides a fluid path with direct fluid communication between the interior 58 and the exterior 68 of the pouch 50. Although not shown, in some embodiments, a second valve may be disposed in or through the closure mechanism 60 or in one of the side edges 56*a*-56*c* of the pouch. Illustrative second valves useful in the present invention include those disclosed in, for example, Newrones et al. U.S. Patent Application Publication No. 2006/0228057, now U.S. Pat. No. 7,837,387. Other valves useful in the present invention include those disclosed in, for example, U.S. patent application Ser. Nos. 11/818,586, and 11/818,592, each filed on Jun. 15, 2007, now U.S. Pat. Nos. 7,946,766 and 7,967,509, respectively.

In use, application of a vacuum pressure over the exterior of the first and second apertures 74 and 76 causes the interior 58 of the pouch 50 below the first and second apertures to have a greater pressure than the exterior. Vacuum pressure may be applied by an evacuation pump or a device or any other source of vacuum pressure known in the art, for example, by placing a vacuum cup of the evacuation pump in contact with an outer surface of the pouch and drawing a vacuum on an interior of the vacuum cup, thereby creating an expansive pressure imbalance and holding down the first and second layers 64 and 66 around the pressure imbalance. Illustrative evacuation pumps or devices useful in the present invention include those disclosed in, for example, U.S. patent application Ser. No. 11/818,703, filed on Jun. 15, 2007, now U.S. Pat. No. 8,096,329, and U.S. patent application Ser. No. 12/008,164, filed on Jan. 9, 2008, which was published as U.S. Patent Application Publication No. 2009/0175747 on Jul. 9, 2009, now U.S. Pat. No. 8,192,182.

In another embodiment, as illustrated in FIG. 4A, a region on a surface of the second layer 66 that faces the first layer 64 and that is disposed between the first and second apertures 74, 76, and bounded by the second aperture 76, may also be embossed or otherwise textured with a pattern 65 to define a region of flow channels 67. In a further embodiment, as illustrated in FIG. 4B, a region on a surface of the first layer 64 that faces the second layer 66 and that is disposed between the first and second apertures 74, 76, and at least partially overlapping the second aperture 76, may also be embossed or otherwise textured with the pattern 65 to define the region of flow channels 67. In these embodiments, the first and second layers 64 and 66 are in direct contact in an intermediate seal region 87 between the first aperture 74 and the region of flow channels 67, which is in fluid communication with the interior 58 of the pouch 50. In use, application of vacuum pressure over the exterior of the first aperture 74 and a portion of the region of flow channels 67 causes gas resident within the region of flow channels 67 to have a greater pressure than the exterior.

It is further contemplated that the pouch 50 may include a one-way valve disposed on at least one of the first and second pouch sidewalls and flow channels disposed on at least one of the first and second pouch sidewalls and in fluid communication with the one-way valve, and may be provided as a component of a kit or package that comprises a vacuum pump to evacuate gas from the interior of the pouch through the one-way valve.

Although not shown, a porous or adhesive layer disposed between one or more of the valve layers 64, 66 may also be desired in any of the embodiments disclosed herein. Examples of adhesives useful in the present invention include those described in, for example, Hamilton U.S. Pat. No. 7,004,632 or Mizuno U.S. Pat. No. 5,989,608. Examples of a porous material useful in the present invention include those described in, for example, Mizuno U.S. Pat. No. 5,989,608 or Shah et al. U.S. Patent Application Publication No. 2004/0223667, now U.S. Pat. No. 7,137,738.

In the creation of a thermal seal between two or more layers of thermoplastic material, energy and/or pressure may be applied to a target sealing region to at least partially melt one or more of the layers, such that melted portions between any two layers create a bond therebetween. A consequence of applying energy and/or pressure to melt the material in the target region may be that the melted material flows away from the target region. This flow of material away from the target region may form wrinkles in one or more of the layers. Such wrinkles may be aesthetically or otherwise undesirable. For example, such wrinkles may inhibit or prevent formation of a gastight seal between the wrinkled layers. However, the creation of wrinkles may be alleviated by several techniques. For example, in the creation of a heat seal, heat may be applied to an entire layer (or layers) to pre-heat the material prior to creating the heat seal. Further, heat may be applied to multiple layers of material from both a top side and a bottom side to alleviate uneven material expansion due to temperature gradients through the material. In the creation of a seal by ultrasonic vibration, a vibrating surface may be forced against the layers of material to melt the layers and to create a bond therebetween. Wrinkling may be alleviated in a desired region of the material by angling the vibrating surface away from the desired region to push the melted material away therefrom.

Wrinkling may also be alleviated by the use of intermittent spot seals to create a seal region. For example, referring to FIGS. 6B-6D, the second layer 66 may be sealed to the first sidewall 52 by an intermittent spot seal 278*a* along the peripheral edge 94 and by an intermittent spot seal 278*b* along the peripheral edge 98. In one embodiment, illustrated in FIG. 6A, individual sealing spots of the intermittent spot seals 278*a* and 278*b* may be coincident with individual sealing spots of the respective intermittent spot seals 178*a* and 178*b*. In another embodiment, as schematically illustrated in FIGS. 6B-6D, the individual sealing spots of the intermittent spot seal 178*a* are staggered with respect to the individual sealing spots of the intermittent spot seal 278*a*, and/or the individual sealing spots of the intermittent spot seal 178*b* are similarly staggered with respect to the individual sealing spots of the intermittent spot seal 278*b*.

Figure 6B:
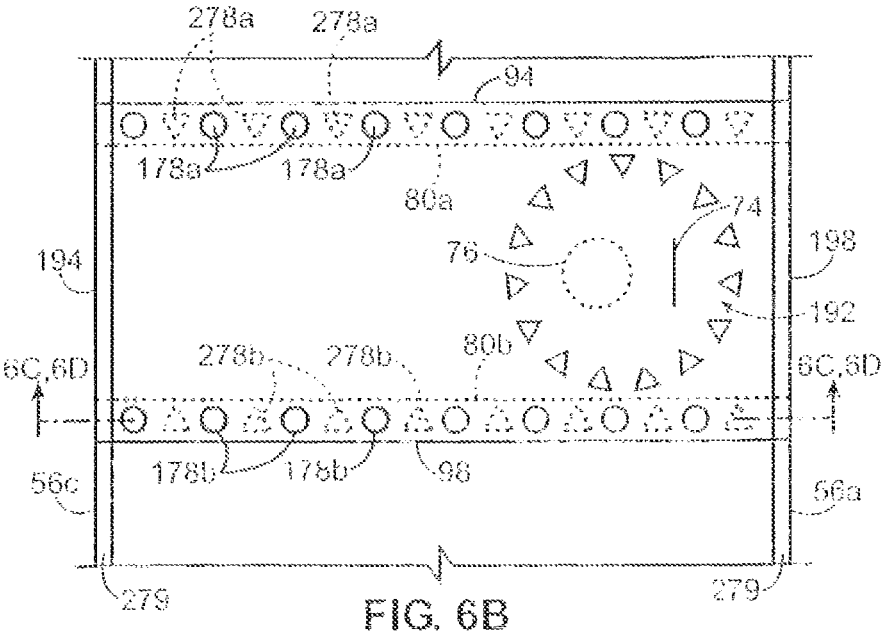
FIG. 6B is a fragmentary plan view of a first sidewall of a pouch illustrating another embodiment of intermittent spot seals.

Optional strips 80*a*, 80*b* of the thermoplastic weld layer material may extend along the respective peripheral edges 94, 98, as illustrated by dashed lines in FIG. 6B. Each of the optional strips may be sandwiched between the second layer 66 and the first sidewall 52, as illustrated in FIG. 6D. An edge seal 279 may seal the edges 56*a* and 56*c*.

Figure 6C:
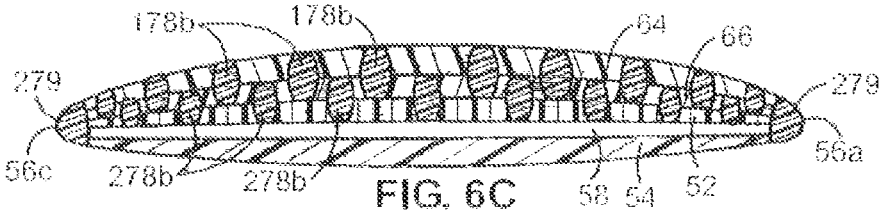
FIG. 6C is a cross-sectional view of one possible embodiment of the intermittent spot seal of FIG. 6B taken generally along the lines 6C-6C of FIG. 6B.
Figure 6D:
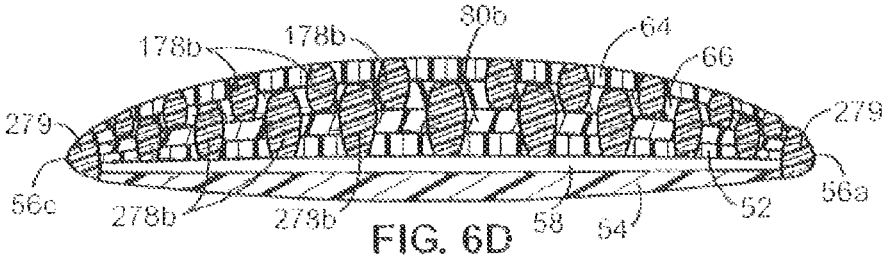
FIG. 6D is a cross-sectional view of another possible embodiment of the intermittent spot seal of FIG. 6B taken generally along the lines 6D-6D of FIG. 6B.

Each of the individual sealing spots that comprise the intermittent spot seals 178*b* and 278*b* that are schematically illustrated in FIGS. 6C and 6D has a melt region around at least a portion thereof. For example, each of the individual sealing spots of the intermittent spot seal 278*b* may comprise molten material comprised of one or more of the second layer, 66, the optional strip of thermoplastic weld layer material 80*b*, and the first sidewall 52.

Figure 6E:
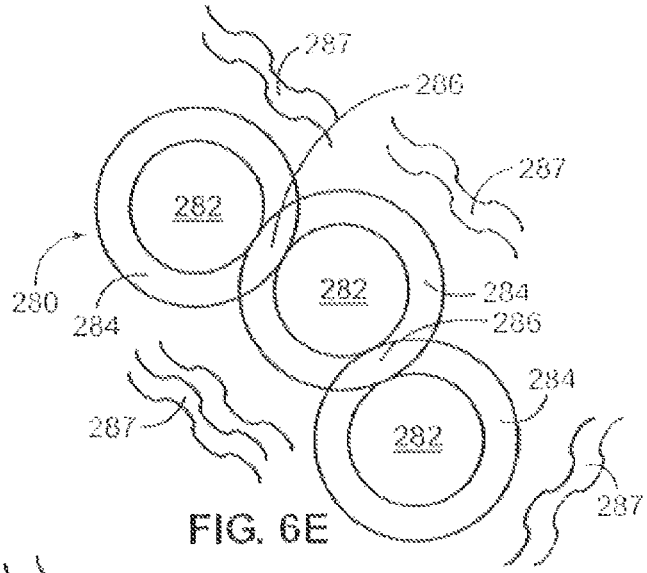
FIG. 6E is a close-up view of an intermittent spot seal that comprises individual circular spots.

Illustratively referring to FIG. 6E, a generally curved intermittent spot seal 280 between two or more layers of thermoplastic material includes generally circular individual sealing spots 282. Each of the circular individual sealing spots 282 may be surrounded by a generally symmetric melt region 284. If the circular individual sealing spots 282 are not spaced sufficiently from one another, portions of the symmetric melt regions 284 of the adjacent circular individual sealing spots 282 may overlap, as shown by overlap regions 286. Wrinkles 287 that are created in the thermoplastic material surrounding the symmetric melt regions 284 may be exacerbated by the overlap regions 286.

Figure 6F:
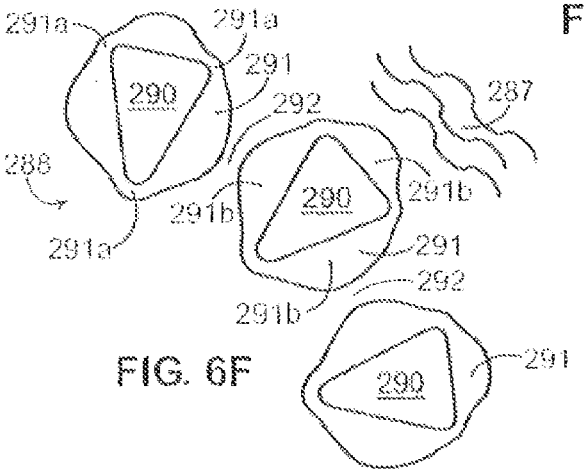
FIG. 6F is a close-up view of an intermittent spot seal that comprises individual triangular spots.

Referring to FIG. 6F, a portion of generally curved intermittent spot seals 288 includes generally triangular individual sealing spots 290. Each of the triangular individual sealing spots 290 may be surrounded by a generally asymmetric melt region 291. The wrinkles 287 may be less likely to form in this example than in the example described with regard to FIG. 6E above because, for example, the triangular individual sealing spots 290 are spaced sufficiently far apart, such that non-overlap regions 292 remain between the asymmetric melt regions 291. Further, corner regions 291*a* of the asymmetric melt regions 291 opposite to the corners of the triangular individual sealing spots 290 are generally thinner than side regions 291*b* of the asymmetric melt regions 291 opposite to the sides of the triangular individual sealing spots 290. Therefore, the wrinkles 287 may be less likely to form in localized areas of the thermoplastic material opposite to the corner regions 291*a* than the side regions 291*b*.

Figure 5:
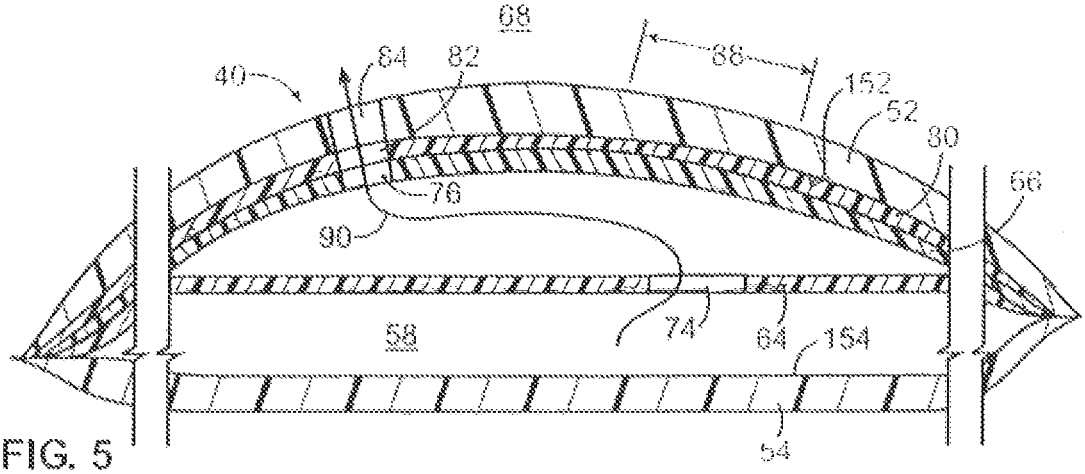
FIG. 5 is a fragmentary cross-sectional view of another embodiment of a valve taken generally along the lines 3-3 of FIG. 1A, with first and second layers thereof separated and with portions behind the plane of the cross section omitted for clarity.

In another embodiment, depicted in FIG. 5, the first and second layers 64 and 66, and the thermoplastic weld layer 80, are disposed on the interior 58 of the pouch 50. In this embodiment, the opening region 88 of the second layer 66 is disposed directly over the first aperture 74 disposed in the first layer 64. In all of the embodiments described herein, either the first aperture 74 or the second aperture 76 may be in fluid communication with the exterior 68 of the pouch 50 or, for example, may be covered by an additional layer (not shown) to protect or to hide the aperture 74 or 76. The aperture 74 or 76 that is in fluid communication with the exterior 68 of the pouch 50 may be a slit or a hole or opening of any cross section, for example, circular, square-shaped, triangular, rectangular, pentagonal, or any other suitable shape.

Figure 6G:
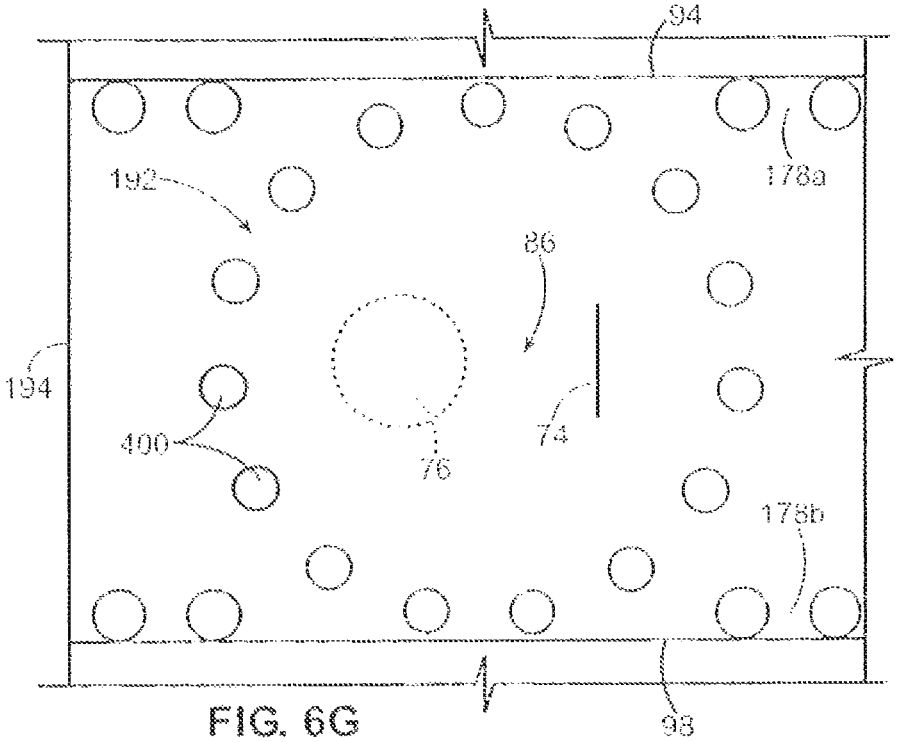
FIG. 6G is a fragmentary plan view of an embodiment of a valve.
Figure 6H:
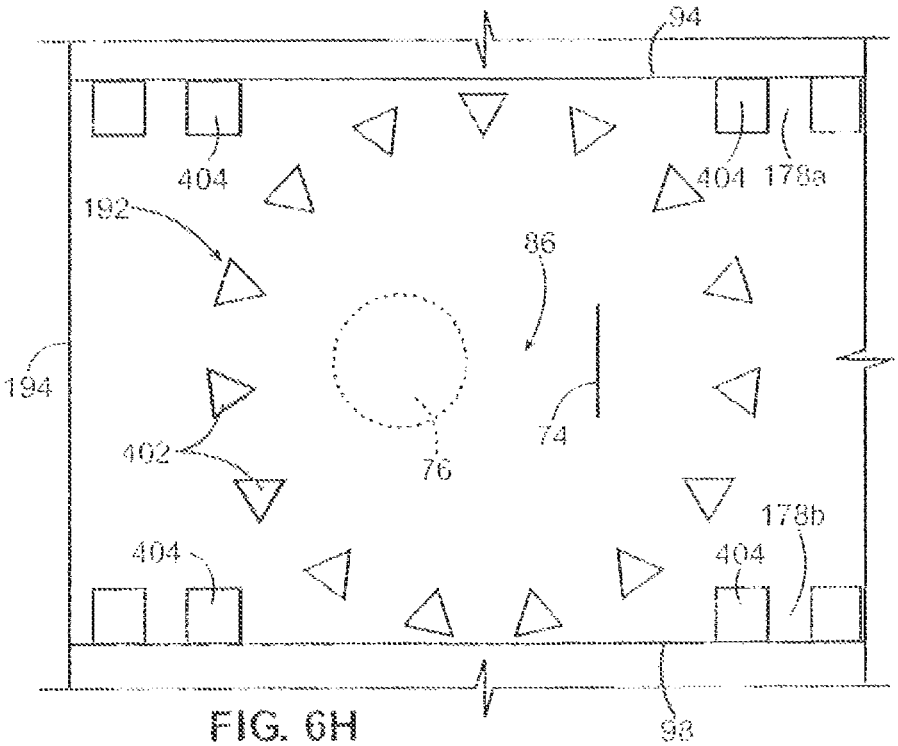
FIG. 6H is a fragmentary plan view of another embodiment of a valve.
Figure 7:
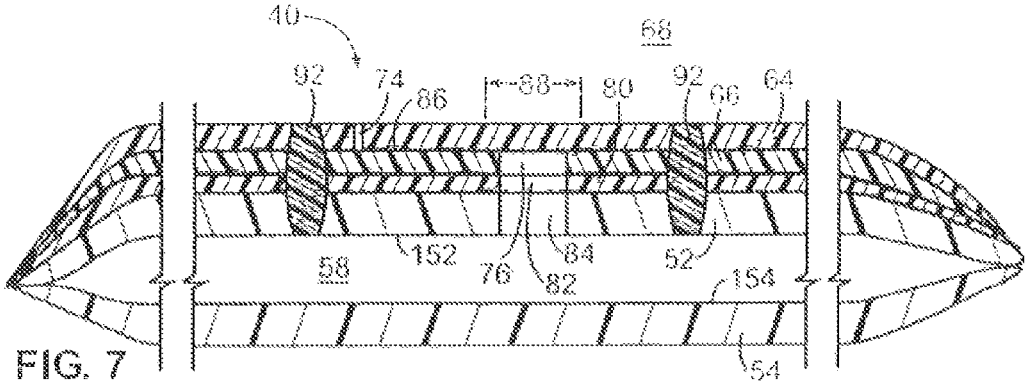
FIG. 7 is a fragmentary cross-sectional view taken generally along the lines 7-7 of FIG. 6, with portions behind the plane of the cross section omitted for clarity.

Referring next to FIGS. 6 and 7, in a further embodiment, the first and second layers 64 and 66, the thermoplastic weld layer 80, and the first sidewall 52 are further attached together by a surrounding thermal seal 92. The surrounding thermal seal 92 may be a continuous seal as shown in FIG. 6, or may an intermittent spot seal 192 as shown in FIGS. 6A, 6G, and 6H. The surrounding thermal seal 92 may optionally be disposed between only the first and second layers 64 and 66. Alternatively, the first and second layer 64 and 66, and the surrounding thermal seal 92, surrounds the first aperture 74 and the second aperture 76. The surrounding thermal seal 92 may be a heat seal, a seal formed by ultrasonic vibration, or a thermal seal formed by any thermal sealing method known in the art. Although shown as a circular seal in FIGS. 6, 6A, 6G, and 6H, the surrounding thermal seal 92 may have any shape, for example, triangular, elliptical, square-shaped, pentagonal, hexagonal, etc.

Although the individual sealing spots that comprise the intermittent spot seals 178*a*, 178*b*, and 192 are shown in FIG. 6A to be generally circular, the individual sealing spots may be, for example, circular, elliptical, square-shaped, triangular, rectangular, pentagonal, hexagonal, or other shapes. Referring to FIGS. 6G and 6H, in some embodiments, the intermittent spot seal 192 may have an odd plurality of circular individual sealing spots 400, for example, three, five, seven, nine, eleven, thirteen, fifteen, seventeen, or more, such that a substantially gastight seal can form between the layers joined by the intermittent spot seal 192. In some cases, an odd number of the individual sealing spots 400 may inhibit the formation of a wrinkle (not shown) that spans the intermittent spot seal 192 between pairs of the individual sealing spots 400 that are aligned with one of the side edges 56*a*-56*c* of the pouch 50. The number, size, and space of the circular individual sealing spots 400 may each be predetermined to minimize formation of wrinkles (not shown) within a perimeter of the intermittent spot seal 192 that may interfere with the formation of a substantially gastight seal in the intermediate sealing region 86 between the offset first and second apertures 74 and 76. For example, the intermittent spot seal 192 may be configured such that the symmetric melt regions 284 surrounding the adjacent circular individual sealing spots 400 do not overlap.

In another embodiment, the intermittent spot seal 192 may be comprised of an odd plurality of triangular individual sealing spots 402, as illustrated in FIG. 6H. The number, size, and spacing of the triangular individual sealing spots 402 may also each be predetermined to minimize formation of wrinkles (not shown) within a perimeter of the intermittent spot seal 192. For example, the intermittent spot seal 192 may be configured such that the asymmetric melt regions 291 surrounding the adjacent triangular individual sealing spots 402 do not overlap, and further, such that the corner regions 291*a* of the asymmetric melt regions 291 point toward a central portion within the intermittent spot seal 192. FIG. 6H further illustrates that the intermittent spot seals 178*a* and 178*b* may be comprised of individual sealing spots 404 that have a different shape than the triangular individual sealing spots 402, for example, rectangular, as shown.

Figure 8:
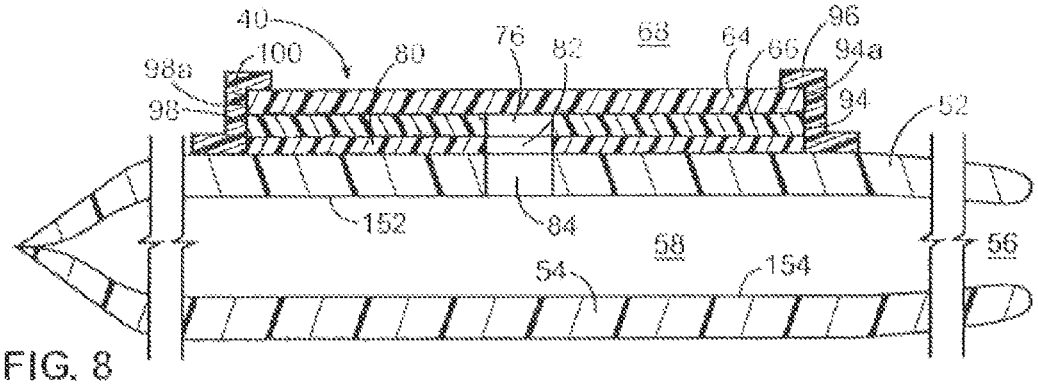
FIG. 8 is a fragmentary cross-sectional view taken generally along the lines 2-2 of FIG. 1A and illustrating yet another embodiment of a valve, with portions behind the plane of the cross section omitted for clarity.
Figure 8A:
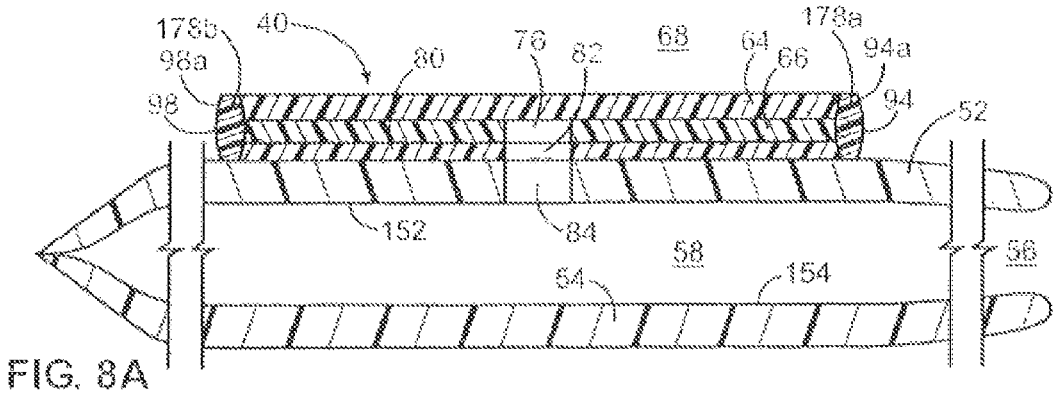
FIG. 8A is a fragmentary cross-sectional view taken generally along the lines 8A-8A of FIG. 6A and illustrating another embodiment of a valve, with portions behind the plane of the cross section omitted for clarity.

In yet another embodiment, as seen in FIG. 8, first edges 94*a* and 94 of the first and second layers 64 and 66, respectively, are attached to the first sidewall 52 by a first edge thermoplastic weld layer 96, and second edges 98*a* and 98 of the first and second layers 64 and 66, respectively, are attached to the first sidewall 52 by a second edge thermoplastic weld layer 100. Alternatively, as seen in FIG. 8A, the first edges 94*a* and 94 of the first and second layer 64 and 66, respectively, are attached to the first sidewall 52 by the intermittent spot seal 178*a*, and the second edges 98*a* and 98 of the first and second layers 64 and 66, respectively, are attached to the first sidewall 52 by the intermittent spot seal 178*b*. Illustratively, the first and second edge thermoplastic weld layers 96, 100 and the intermittent spot seals 178*a*, 178*b* are disposed across the full width 62 (FIG. 1) of the first sidewall 52. The first and second layers 64 and 66 and the first and second edge thermoplastic weld layers 96, 100 or the intermittent spot seals 178*a*, 178*b* may, alternatively, be disposed across a portion of the first sidewall 52, or on the interior 58 of the pouch 50.

Figure 9:
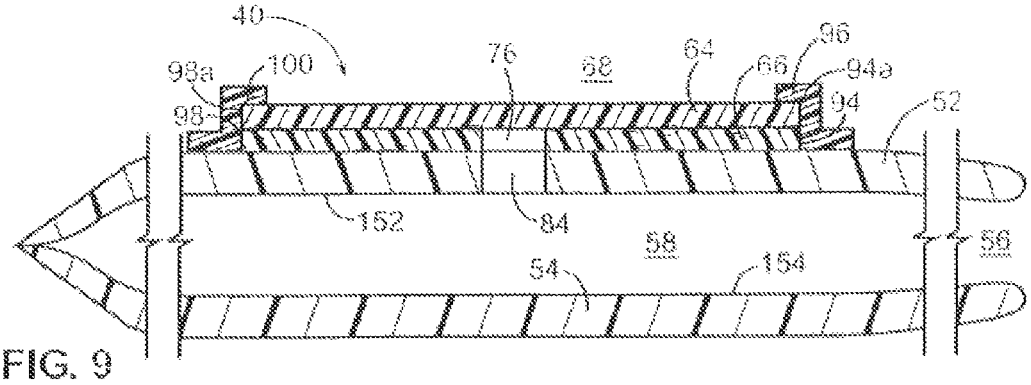
FIG. 9 is a fragmentary cross-sectional view taken generally along the lines 2-2 of FIG. 1A and illustrating a still further embodiment of a valve, with portions behind the plane of the cross section omitted for clarity.
Figure 9A:
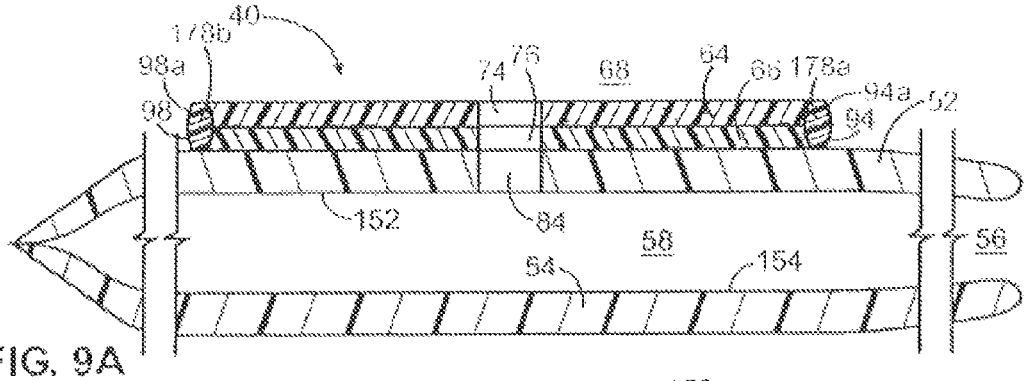
FIG. 9A is a fragmentary cross-sectional view taken generally along the lines 9A-9A of FIG. 6A and illustrating another embodiment of a valve, with portions behind the plane of the cross section omitted for clarity.

A still further embodiment is depicted in FIG. 9, wherein the entire second layer 66 is sealed directly to the first sidewall 52. The first edge 94*a* of the first layer 64 is attached to the first sidewall 52 by the first edge thermoplastic weld layer 96, and the second edge 98*a* of the first layer 64 is attached to the first sidewall 52 by the second edge thermoplastic weld layer 100. Alternatively, as depicted in FIG. 9A, the first edge 94*a* of the first layer 64 is attached to the first sidewall 52 by the intermittent spot seal 178*a*, and the second edge 98*a* of the first layer 64 is attached to the first sidewall 52 by the intermittent spot seal 178*b*. The first and second layers 64 and 66 and the first and second edge thermoplastic weld layers 96, 100 or the intermittent spot seals 178*a*, 178*b* may alternatively be disposed on the interior 58 of the pouch 50.

Figure 10:
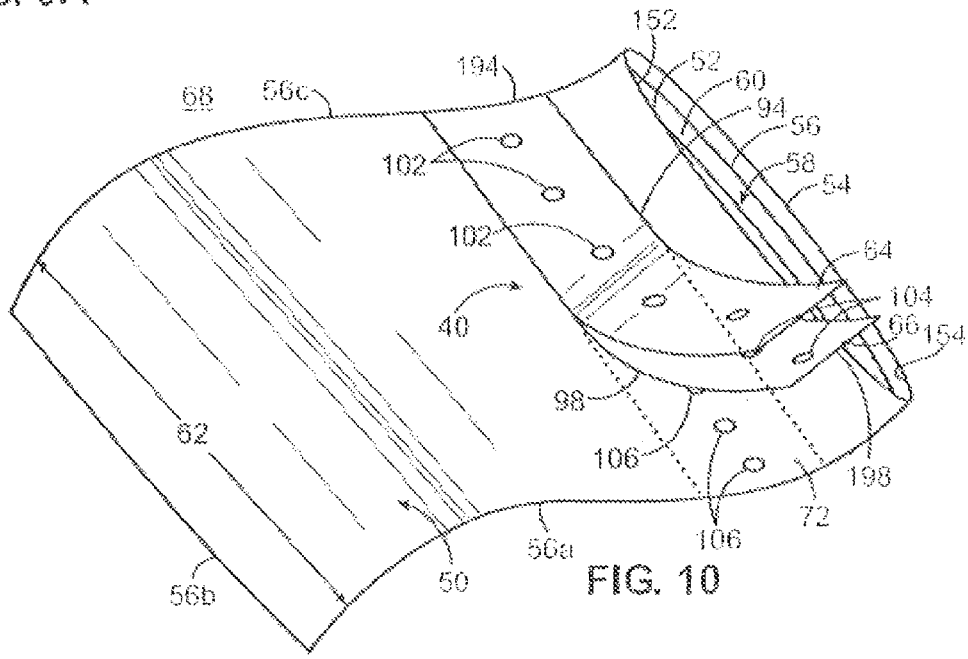
FIG. 10 is an isometric view of the reclosable pouch illustrating still another embodiment of a valve with valve layers peeled up for clarity.

Referring next to FIG. 10, in still another embodiment, a first plurality of apertures 102 extends through the first layer 64. A second plurality of apertures 104 extends through the second layer 66, wherein the second plurality of apertures 104 is offset from the first plurality of apertures 102. A third plurality of apertures 106 extends through the first sidewall 52 of the pouch 50. The second and third pluralities of apertures 104 and 106 are arranged to be coincident along a line perpendicular to the first sidewall 52, thereby allowing fluid communication of the second plurality of apertures 104 with the interior 58 of the pouch 50. Alternatively, the first and second layers 64 and 66 may be disposed on the interior 58 of the pouch 50.

Figure 11:
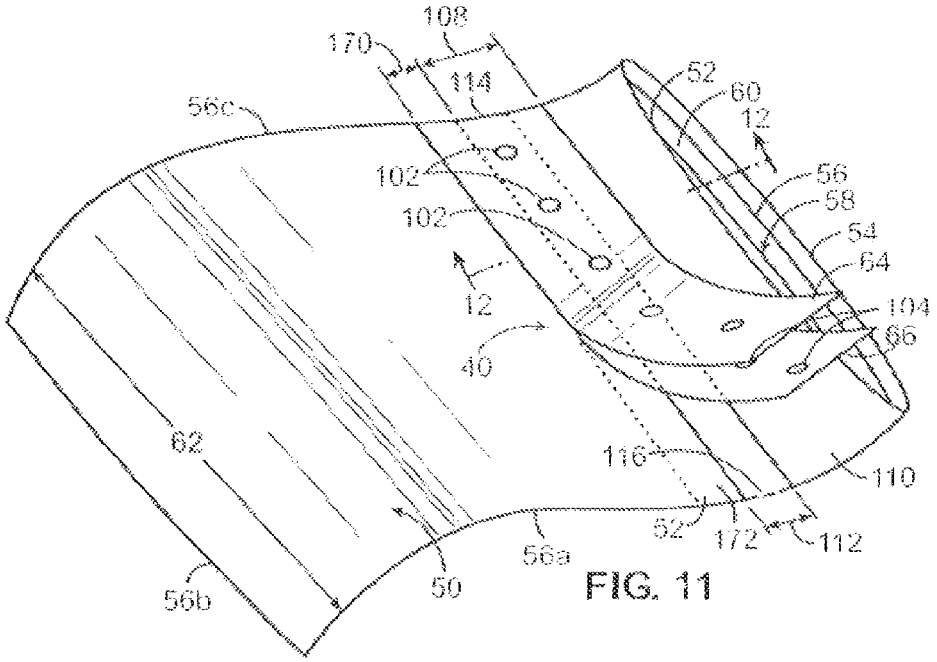
FIG. 11 is an isometric view of the reclosable pouch illustrating a yet further embodiment of a valve with valve layers peeled up for clarity.
Figure 12:
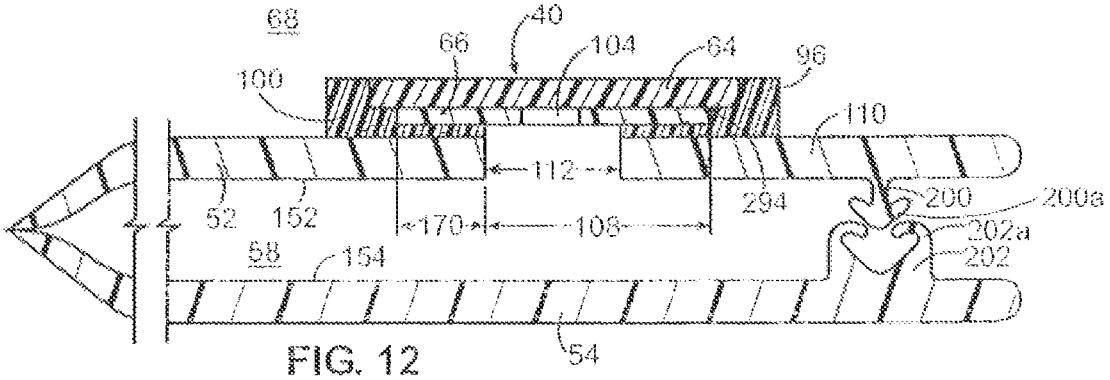
FIG. 12 is a fragmentary cross-sectional view taken generally along the lines 12-12 of FIG. 11, with portions behind the plane of the cross section omitted for clarity.

In a yet further embodiment, as seen in FIGS. 11 and 12, the second layer 66 includes an overlap region 170 that overlaps the first sidewall 52 and a portion 108 that does not overlap with the first sidewall. The projection 172 of the overlap region 170 of the second layer 66 is shown by the area outlined by the dashed line in FIG. 11. An edge 294 of the second layer 66 is joined to a closure flange 110 that may have a first closure element 200 disposed thereon, leaving a gap 112 across the full width 62 of the pouch 50 between the first sidewall 52 and the closure flange. A second closure element 202 may also be disposed on the second sidewall 54 opposing the first closure element 200. The closure elements 200 and 202 may be any type of complementary interlocking closure elements known in the art, as previously described herein. The second plurality of apertures 104 is in fluid communication with the interior 58 of the pouch 50 through the gap 112. The gap 112 is sealed along first and second ends 114 and 116 between the first layer 64 and the second sidewall 54. The first and second edge thermoplastic weld layers 96 and 100 extend partially under the second layer 66 to attach the first and second layers 64 and 66 together and to attach the first and second layers to the first sidewall 52 and the closure flange 110, respectively. In place of the thermoplastic weld layers 96, 100, the intermittent spot seals 178*a*, 178*b* may attach the first and second layers 64 and 66 together and attach the first and second layers to the first sidewall 52 and the closure flange 110, respectively. Alternatively, the first and second layers 64 and 66 and the first and second edge thermoplastic weld layers 96, 100 or the intermittent spot seals 178*a*, 178*b* may be disposed on the interior 58 of the pouch 50.

The first and second layers 64 and 66 of any of the valves 40 as disclosed herein may be independently composed of any thermoplastic material, such as would be used for the first and second sidewalls 52 and 54 of the pouch 50 as described herein. Each of the first and second layers 64 and 66 may be composed of the same material as the other layer or could be independently composed of different material than that of the other layer. In addition, each of the first and second layers 64 and 66 may also have multiple plies, each ply being independently composed of any thermoplastic material, such as would be used for the first and second sidewalls 52 and 54 of the pouch 50 as described herein, or a blend of any thermoplastic material, such as would be used for the first and second sidewalls of the pouch as described herein. Illustratively, the first and second layers 64 and 66 may, for example, be composed of a polyolefin plastomer, such as an AFFINITY™ resin manufactured by Dow Plastics.

Figure 13:
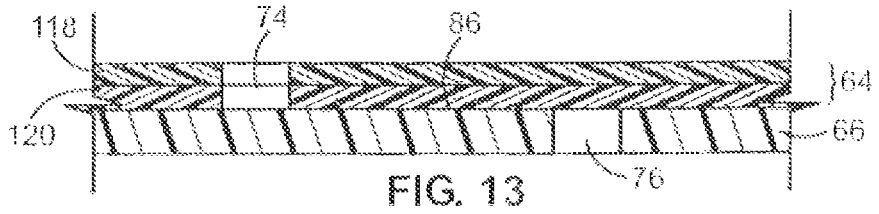
FIG. 13 is a partial cross-sectional view depicting layers and plies for a valve and taken generally along the lines 3-3 of FIG. 1A, with portions behind the plane of the cross section omitted for clarity.
Figure 14:
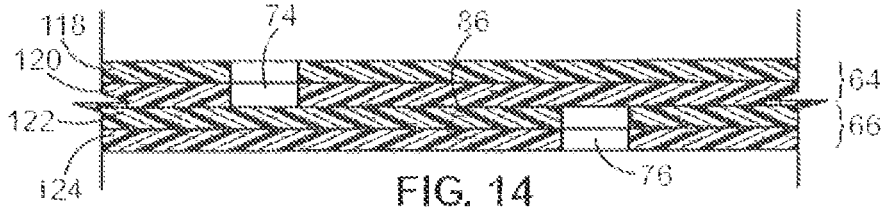
FIGS. 14 and 15 are partial cross-sectional views, similar to the view of FIG. 13 illustrating alternative constructions of layers and plies for valves herein.
Figure 15:
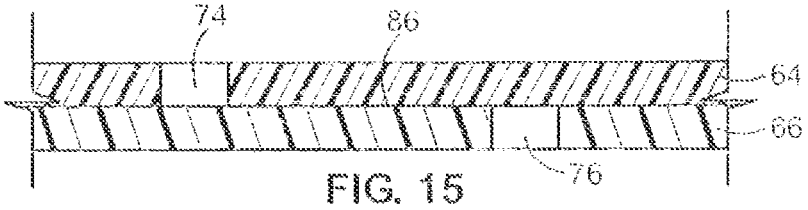

FIGS. 13-15 depict various illustrative embodiments for the first and second layers 64 and 66. Referring to FIG. 13, the first layer 64 is composed of a first ply 118 and a second ply 120. Although any suitable flexible thermoplastic materials may be used for the first and second plies 118 and 120, in this embodiment, for example, the first ply 118 is composed of polypropylene or HDPE and the second ply 120 is composed of a polyolefin plastomer. The second layer 66 in FIG. 13 includes a single ply and may be made of any suitable flexible thermoplastic, but illustratively, the second layer 66 is made of polypropylene, HDPE, polyolefin plastomer, or a blend of any two or all three of polypropylene, HDPE, and polyolefin plastomer. The structures of the first and second layers 64 and 66 may also be reversed such that the first layer 64 has a single ply and the second layer 66 has two plies. Other additives known to those skilled in the art may also be included in the composition of the first and second layers 64 and 66, as desired, such as to improve handling and manufacturing characteristics.

As seen in FIG. 14, the first layer is substantially identical to that shown in FIG. 13, and the second layer 66 is composed of a first ply 122 and a second ply 124. Although any suitable flexible thermoplastic materials may be used for the first and second plies 122 and 124 of the second layer 66, in this embodiment, for example, the first ply 122 is composed of a polyolefin plastomer and the second ply 124 is composed of polypropylene or HDPE.

Referring next to FIG. 15, the first and second layers 64 and 66 are both composed of a single ply of material. Although any suitable flexible thermoplastic materials may be used for the first and second layers 64 and 66, illustrative materials are polyolefin plastomer, polypropylene, HDPE, or a blend of any two or all three of polypropylene, HDPE, and polyolefin plastomer.

Although not shown, it is also contemplated that one or more of the valves 40 or valve layers, for example, the first and second layers 64 and 66, may extend along a portion of the width 62 of the pouch 50. For example, one or more of the valve layers may extend only along a portion of the pouch 50 proximate to one side edge of the pouch, or may be disposed away from the side edges of the pouch toward the center of the pouch, or may be offset from the center of the pouch. However, by extending the valve 40 across the entire width 62 of the pouch 50, it is contemplated that the complexity of manufacturing the valve and/or pouch may be reduced, because the first and second layers 64 and 66 may be applied in a continuous process.

Figure 16:
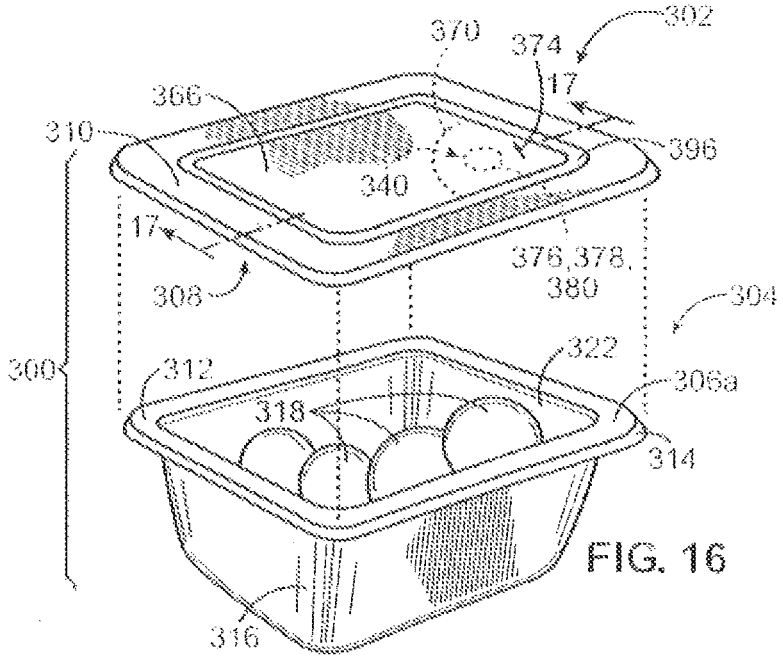
FIG. 16 is an isometric view of another embodiment of a valve on a container.
Figure 17A:
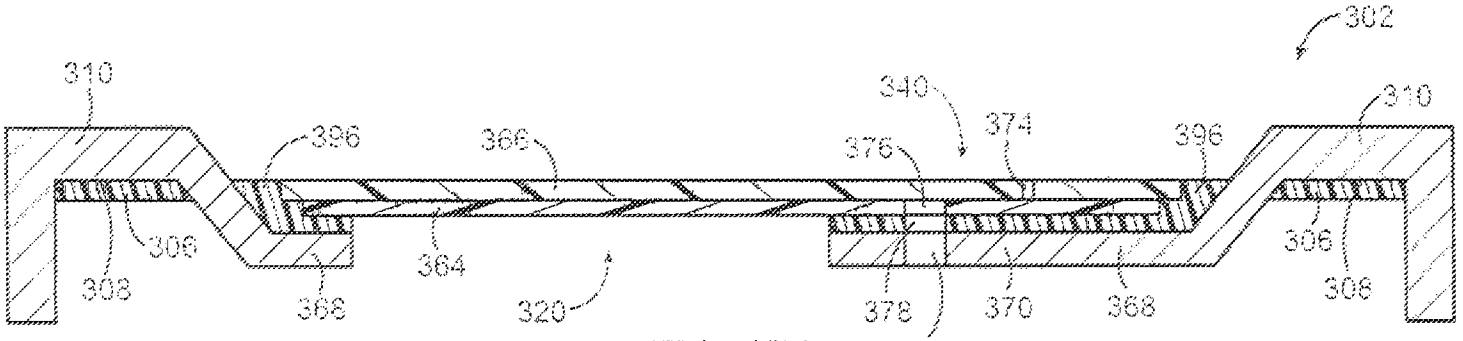
FIG. 17A is a cross-sectional view taken generally along the lines 17-17 of FIG. 16, with portions behind the plane of the cross section omitted for clarity.

Referring next to FIGS. 16 and 17A, a container 300 having a container lid 302 that includes a valve 340 and that sealingly fits on a hard-walled container body 304 is illustrated. A container useful herein includes those disclosed in, for example, Zettle et al. U.S. Pat. No. 6,032,827 or Stanos et al. U.S. Pat. No. 7,063,231. A sealing layer 306 may be applied to an inner surface 308 of a peripheral rim 310 of the lid 302 to assist in achieving a gastight seal therebetween. A second sealing layer 306*a* of the same or a different sealing material may also be applied to a surface 312 of a peripheral lip 314 of the container body 304. Any suitable sealing material known to those skilled in the art may be used, including, for example, one or more polyolefin plastomers, including, for example, an AFFINITY™ resin manufactured by Dow Plastics. The container body 304 may have rigid sidewalls 316 to support a variety of contents 318, for example, fresh vegetables or other perishable foodstuffs, and may be made of any suitable material known to those skilled in the art, including, for example, a thermoplastic resin.

In this embodiment, a first layer 364 is disposed over an opening 320 defined by an inner annular flange 368 of the lid 302. A second layer 366 is also disposed over the opening 320. A first aperture 374 extends through the second layer 366, and a second aperture 376 is offset from the first aperture 374 and extends through the first layer 364. Illustratively, a peripheral thermoplastic weld layer 396 extends partially under the first layer 364 to weld the first and second layers 364 and 366 together, and to weld the first and second layers to the inwardly projecting annular flange 368. The annular flange 368 has an extension 370 that further extends from the annular flange toward the opening 320. A third aperture 378 extends through the peripheral thermoplastic weld layer 396, and a fourth aperture 380 extends through the flange extension 370. The second, third, and fourth apertures 376, 378, and 380 are aligned along a line perpendicular to the flange extension 370, such that the second aperture 376 is in fluid communication with an interior 322 of the container body 304 when the lid 302 is applied thereto.

Figure 17B:
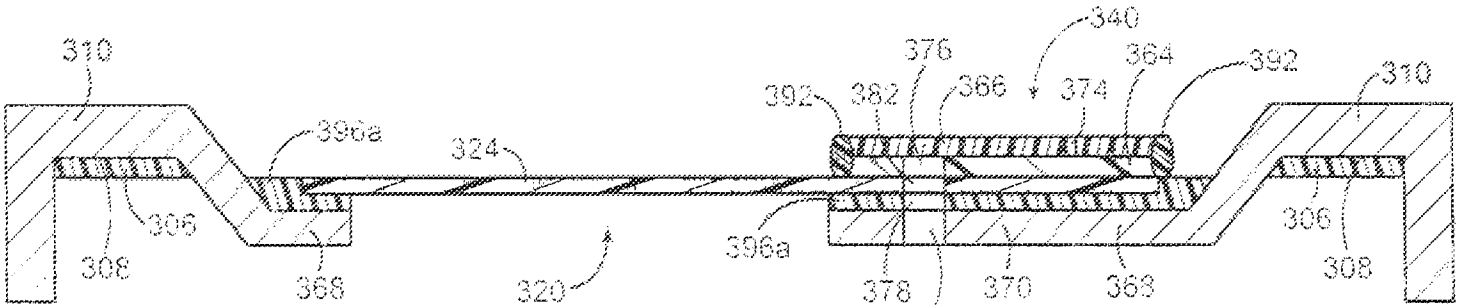
FIG. 17B is a cross-sectional view taken generally along the lines 17-17 of FIG. 16 and illustrating yet another embodiment of a valve, with portions behind the plane of the cross section omitted for clarity.

Referring to FIG. 17B, another embodiment of the lid 302 is illustrated having an elastomeric film layer 324 that spans the opening 320 defined by the annular flange 368 of the lid 302. The film layer 324 is made of a flexible thermoplastic material, for example, polyolefin plastomer, polypropylene, HDPE, or a blend of any two or all three of polypropylene, HDPE, and polyolefin plastomer. The film layer 324 is attached to the annular flange and the flange extension 370 by any suitable method known in the art, for example, by ultrasonic or thermal welding, by application of an adhesive, or by a thermoplastic weld layer 396*a*.

This embodiment is similar to the embodiment discussed in regards to FIG. 17A, except for the differences described in the following. The first layer 364 and the second layer 366 are disposed only over the extent of the flange extension 370. A fifth aperture 382 extends through the film layer 324 and is aligned with the second, third, and fourth apertures 376, 378, and 380 along a line perpendicular to the flange extension 370, such that the second aperture 376 is in fluid communication with the interior 322 of the container body 304 when the lid 302 is applied thereto. The first and second layers 364 and 366 may be applied to the film layer 324 over the flange extension 370 by any suitable method known in the art, for example, by a surrounding seal 392 that surrounds the first and second apertures 374 and 376. The surrounding seal 392 may be a continuous seal or may be an intermittent spot seal, as discussed previously for another embodiment herein regarding the surrounding seal 92.

Figure 18:
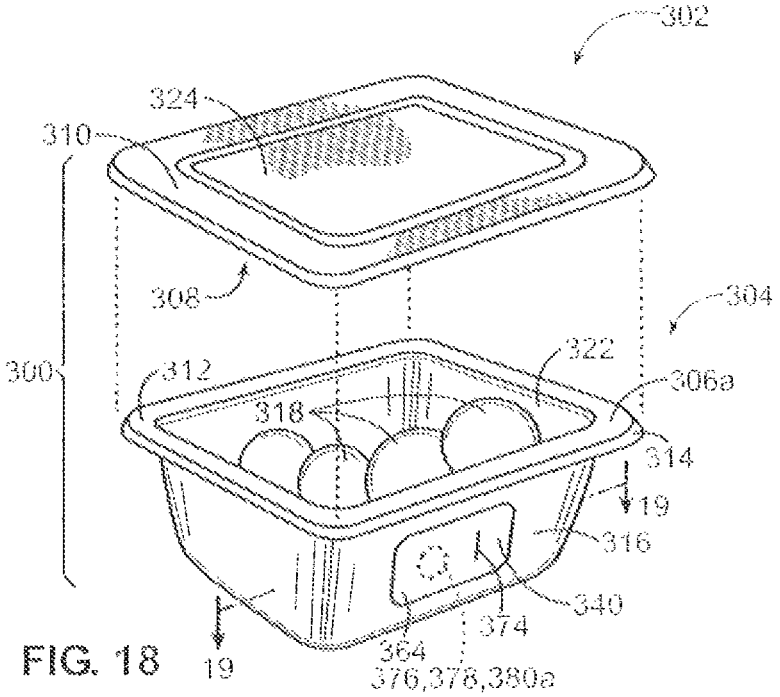
FIG. 18 is an isometric view of a still further embodiment of a valve on a container.
Figure 19:
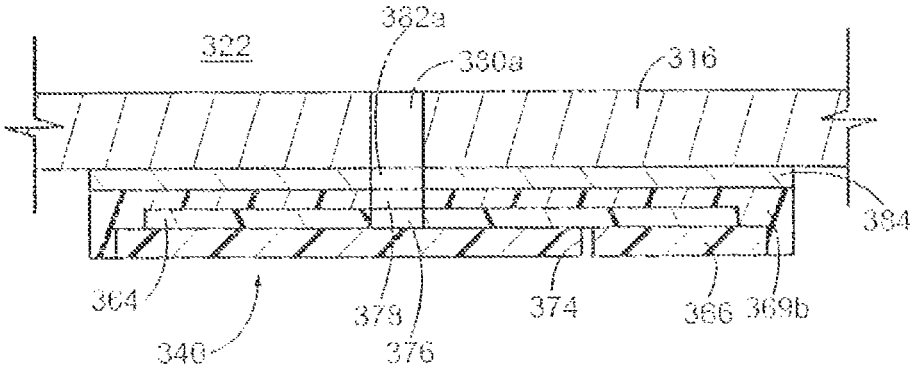
FIG. 19 is a fragmentary cross-sectional view taken generally along the lines 19-19 of FIG. 18, with portions behind the plane of the cross section omitted for clarity.

Further, it is also contemplated that any of the valves described herein, for example, the valve 340, may be constructed independently of the container 300 and applied to the container, such as to the pouch 50, the container lid 302, or the container body 304, after or during the manufacturing thereof. One such embodiment is illustrated in FIGS. 18 and 19, wherein the valve 340 is applied to the container body 304 using an adhesive layer 384. In this embodiment, the film layer 324 of the lid 302 spans the opening 320 and includes no apertures therethrough. Although the adhesive layer 384 is shown to attach the valve 340 to the container body 304, either of the first and second layers 364 and 366 may be, alternatively, or in addition to, attached to the sidewall 316 by any suitable method known in the art, for example, directly by a thermoplastic weld layer 396*b*. The first aperture 374 extends through the second layer 366 and is offset from the second aperture 376 that extends through the first layer 364. The third aperture 378 extends through the thermoplastic weld layer 396*b* and a fourth aperture 380*a* extends through the sidewall 316. A fifth aperture 382*a* extends through the adhesive layer 384. The second, third, fourth, and fifth apertures 376, 378, 380*a*, and 382*a* are aligned along a line perpendicular to the sidewall 316, such that the second aperture 376 is in fluid communication with the interior 322 of the container body 304. Further, it is believed that the embodiments shown in FIGS. 16-19 operate in a fashion similar to the valves 40 described above. Illustratively, after the contents 318 are placed into the container body 304 and the lid 302 is applied thereto, a source of vacuum pressure (not shown) is applied over the first and second apertures 374 and 376. The flange extension 370 or the sidewall 316 provides a support surface for application of the source of vacuum pressure. As gas is removed from the container body 304, the flexible material of the first and second layers 364 and 366 or the film layer 324 are compressed into the container body by atmospheric pressure. The first and second layers 364 and 366 or the film layer 324 cover and conform to the contents 318, as the gas is removed from the container body 304. The first and second layers 364 and 366 or the film layer 324 may be attached to the peripheral flange 368 by any suitable method known in the art, for example, by ultrasonic or thermal welding, or by application of an adhesive.

Figure 20:
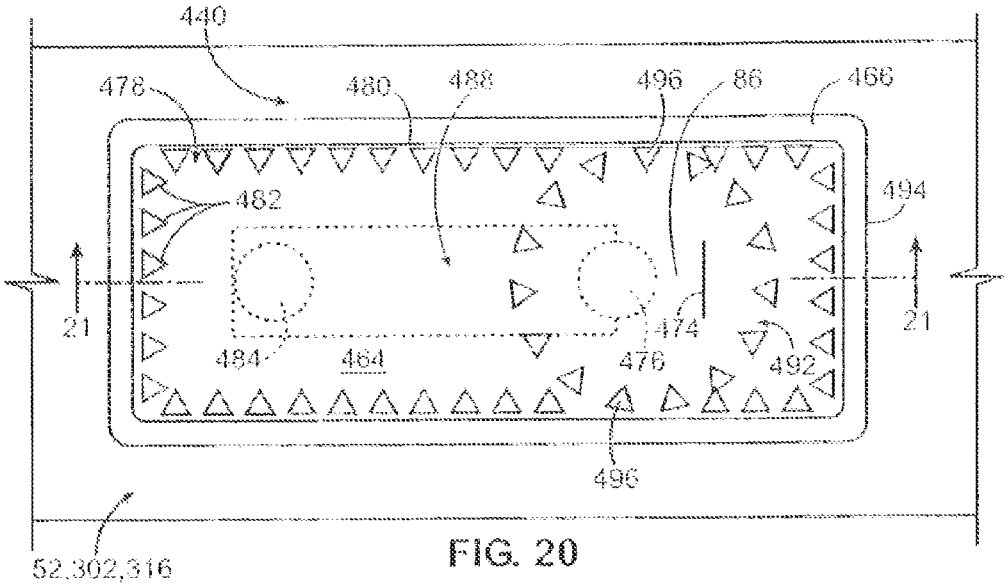
FIG. 20 is a plan view of an embodiment of an independently constructed valve applied to a container.
Figure 21:
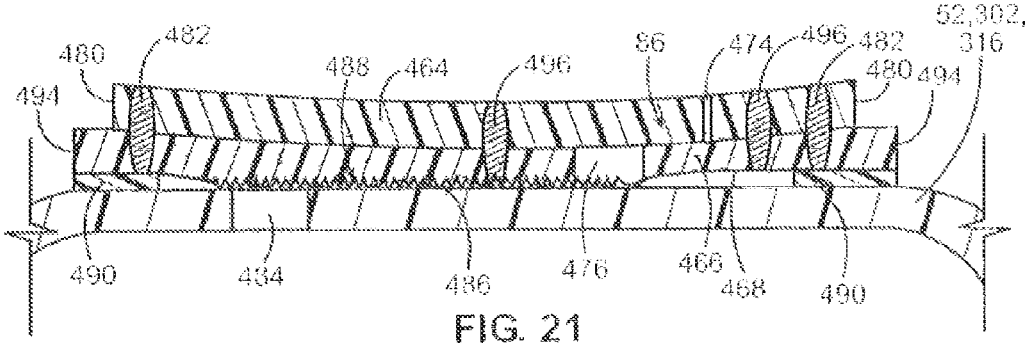
FIG. 21 is a cross-sectional view taken generally along the lines 21-21 of FIG. 20.

Another embodiment of a valve that may be constructed independently of the container 300 as a valve strip 440 and applied to the container, such as to the pouch 50, the container lid 302, and/or the container body 304, after or during the manufacturing thereof is illustratively shown in FIGS. 20 and 21. A first layer 464 of a film material is disposed over a second layer 466 of the film material. Each of the first and second layers 464 and 466 may be comprised of one or more plies of material as described above with regard to the first and second layers 64, 66. The first and second layers 464 and 466 are attached to each other, for example, by a thermal seal 478 around the periphery 480 of the first layer 464. The thermal seal 478 may be continuous (not shown), or may be an intermittent spot seal comprising individual sealing spots 482 of any convenient shape, preferably, triangular, as illustrated in FIG. 20. The thermal seal 478 may be a heat seal, a seal created by ultrasonic vibration, or some other thermal seal as is known in the art.

A first aperture 474 extends through the first layer 464 and a second aperture 476 extends through the second layer 466. A surrounding thermal seal 492 that connects the first and second layers 464 and 466 surrounds the first aperture 474 and the second aperture 476. The surrounding thermal seal 492 may be a heat seal, a seal formed by ultrasonic vibration, or a thermal seal formed by any thermal sealing method known in the art. Although shown as circular in FIG. 20, the surrounding thermal seal 492 may be any shape, for example, triangular, elliptical, square-shaped, pentagonal, hexagonal, etc. Also, the surrounding thermal seal 492 may be continuous (not shown), or may an intermittent spot seal comprising individual sealing spots 496 of any convenient shape, preferably, triangular, as illustrated in FIG. 20. Further, the surrounding thermal seal 492 may be comprised of any number of individual sealing spots 496, for example, fifteen, as illustrated in FIG. 20. The number, size, shape, and spacing of the individual sealing spots 496 may also each be selected to minimize formation of wrinkles (not shown) within a perimeter of the surrounding thermal seal 492, for example, as described above.

A third aperture 484 extends through an exterior wall of the container 300, such as the first sidewall 52, the lid 302, or the container sidewall 316. The second layer 466 has an attachment surface 468 that is adapted to be attached facing the third aperture 484. At least a portion of the attachment surface 468 may also be embossed or otherwise textured with a pattern 486 to define a region of flow channels 488. The valve strip 440 may have a means for attachment 490, for example, a strip or layer or thermoplastic weld material, a direct thermal seal, or an adhesive disposed around the periphery 494 of the attachment surface 468. The means of attachment 490 may be coincident with or one and the same as the thermal seal 478.

In use, the valve strip 440 is placed over the third aperture 484 to create an evacuable container that can be evacuated by a user through the region of flow channels 488 defined between, for example, the attachment surface 468 and the first sidewall 52, the lid 302, or the container sidewall 316. The valve strip 440 may have any convenient shape, for example, including rectangular, circular, elliptical, star shaped, or as desired to match a seating surface of an evacuation source (not shown) that may be applied to the container 300 or the pouch 50.

Figure 22:
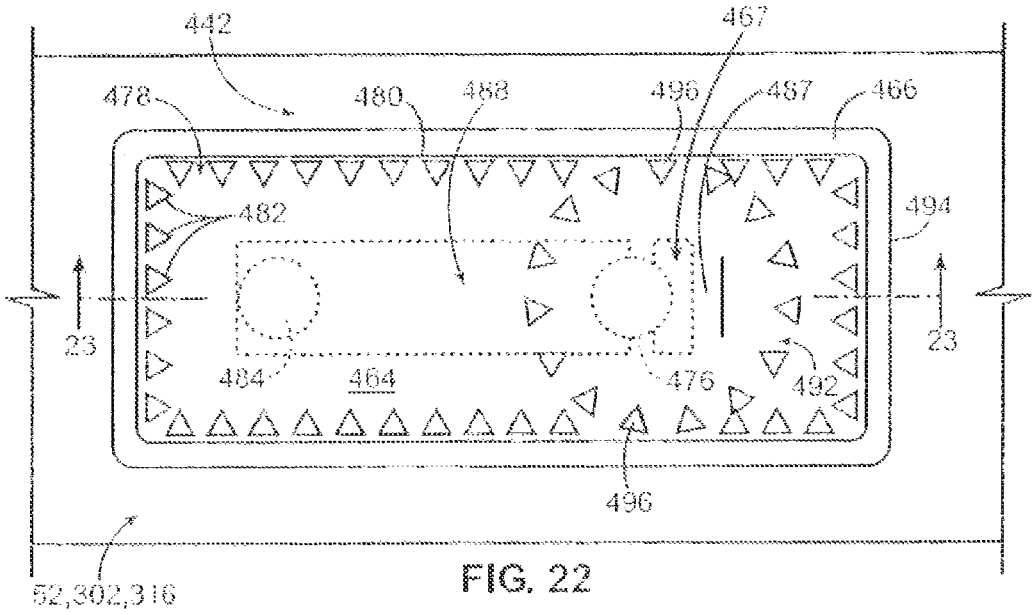
FIG. 22 is a plan view of another embodiment of an independent constructed valve applied to a container.
Figure 23:
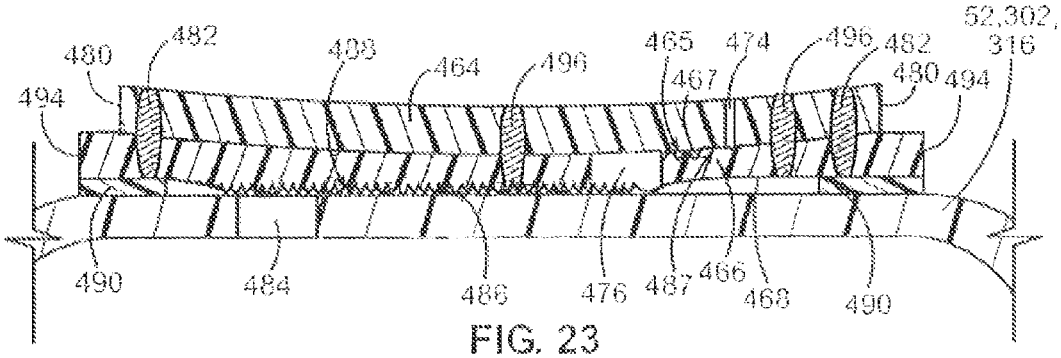
FIG. 23 is a cross-sectional view taken generally along the lines 23-23 of FIG. 22.

In another embodiment of a valve strip 442, as illustrated in FIGS. 22 and 23, a region on a surface of the second layer 466 that faces the first layer 464 and that is disposed between the first and second apertures 474, 476 and bounded by the second aperture 476 may also be embossed or otherwise textured with a pattern 465 to define a region of flow channels 467. In a further embodiment, not shown, a region on a surface of the first layer 464 that faces the second layer 466 and that is disposed between the first and second apertures 474, 476 and at least partially overlapping the second aperture 476 may also be embossed or otherwise textured with the pattern 465 to define the region of flow channels 467. In these embodiments, the first and second layers 464 and 466 are in direct contact in an intermediate seal region 487 between the first aperture 474 and the region of flow channels 467, which is in fluid communication with the third aperture 484 via the second aperture 476 and the region of flow channels 488. In use, application of vacuum pressure over the exterior of the first aperture 474 and a portion of the region of flow channels 467 causes gas resident within the region of flow channels 467 to have a greater pressure than the exterior allowing gas to flow therethrough.

It is further contemplated that any of the embodiments of the valve strip 440, 442 may be provided as a component of a kit or a package that comprises a tool, for example, a hole punch, for creating an aperture in a wall of a container, and/or a vacuum pump to evacuate gas from the interior of the container through the aperture via the valve strip applied over the aperture. In this, or in any of the embodiments shown, the valve 40, 340, or valve strip 440, 442 may be adhered to the pouch 50 or to the container lid 302, film layer 324, or container body 304, as described herein, or by an adhesive known to those skilled in the art, such as described in Engel et al. U.S. Pat. No. 7,178,555 or Hartman et al. U.S. Patent Application Publication No. 2006/0030472, now U.S. Pat. No. 7,244,223. Further, it is contemplated that a variety of containers are suitable for application of the valves 40, 340, or 440 herein described, including, for example, pouches, bowls, bottles, Ziploc® containers, storage boxes, canisters, or other containers, and any lids or covers that may be attachable thereto.

INDUSTRIAL APPLICABILITY

A container is presented that includes a valve to evacuate gas from the container. The valve may include first and second layers of film material that form a substantially gastight seal therebetween upon direct contact of the layers. An intermittent spot seal may attach the first and second layers of film material. A first aperture through the first layer is offset from a second aperture through the second layer. Vacuum pressure disposed over both of the first and second apertures, for example, causes the first layer to separate from the second layer to allow gas to exhaust from the container.

Numerous modifications to the present invention will be apparent to those skilled in the art in view of the foregoing description. Accordingly, this description is to be construed as illustrative only and is presented for the purpose of enabling those skilled in the art to make and to use the invention, and to teach the best mode of carrying out the same. The exclusive rights to all modifications that come within the scope of the appended claims are reserved. All patents, patent publications and applications, and other references cited herein are incorporated by reference herein in their entirety.

We claim:

1. A gastight valve strip for a reclosable container, the reclosable container having a container aperture through a sidewall of the container, the valve strip comprising:

(i) a first film layer having a periphery;

(ii) a second film layer opposing the first film layer and being attached to the first film layer, the first and second film layers adapted to be disposed over a container aperture through a sidewall of the reclosable container, the second film layer comprising an attachment surface being adapted to be sealed to the sidewall of the reclosable container, the attachment surface comprising a patterned portion that defines a region of flow channels, wherein opposing surfaces of the first and second film layers form a substantially gastight seal therebetween upon contact of the first and second film layers to each other;

(iii) a first film layer aperture extending through the first film layer, the first film layer aperture being in fluid communication with an exterior side of the valve strip; and (iv) a second film layer aperture extending through the second film layer, the second film layer aperture being offset and spaced apart from the first film layer aperture, wherein the second film layer aperture is configured to be in fluid communication with the container aperture through the patterned portion of the attachment surface, the patterned portion extending along the attachment surface and into the second film layer aperture, wherein at least a portion of a surface of the second film layer opposite to the attachment surface comprises a patterned portion to provide flow channels in fluid communication with the second film layer aperture, such that a vacuum pressure dispersed over the first film layer aperture and the flow channels separates the first film layer and the second film layer, to allow gas to exhaust from the reclosable container through the container aperture.

2. The gastight valve strip of claim 1, wherein the attachment surface of the second film layer is adapted to be sealed to the sidewall by an adhesive.

3. The gastight valve strip of claim 1, wherein the second film layer is attached to the first film layer by an adhesive.

4. The gastight valve strip of claim 1, wherein the patterned portion of the attachment surface of the second film layer is embossed or textured to provide the fluid communication between the container aperture and the second film layer aperture when the valve strip is attached to the reclosable container.

5. The gastight valve strip of claim 4, wherein the patterned portion of the at least a portion of the surface of the second film layer opposite to the attachment surface is embossed or textured to provide the flow channels in fluid communication with the second film layer aperture.

6. The gastight valve strip of claim 1, further comprising a first thermal seal disposed around the periphery of the first film layer.

7. The gastight valve strip of claim 6, further comprising a second thermal seal between the first and second film layers, the second thermal seal surrounding a region that includes the first film layer aperture and the second film layer aperture.

8. The gastight valve strip of claim 7, wherein the first and second thermal seals are selected from the group consisting of a heat seal and a seal formed by ultrasonic vibration.

9. The gastight valve strip of claim 7, wherein the first and second thermal seals are continuous.

10. The gastight valve strip of claim 7, wherein the first and second thermal seals are intermittent spot seals comprising individual sealing spots.

11. The gastight valve strip of claim 1, wherein the reclosable container is selected from the group consisting of a reclosable pouch, a bowl, a bottle, a storage box, a canister, and a container body having an attachable lid or cover.

12. The gastight valve strip of claim 1, wherein each of the first and second film layers is made of a flexible thermoplastic material selected from the group consisting of polyolefin plastomer, polypropylene, HDPE, and combinations thereof.

13. The gastight valve strip of claim 1, wherein the first film layer aperture and the second film layer aperture are each configured to be spaced apart and offset from the container aperture when the valve strip is attached to the reclosable container.

14. The gastight valve strip of claim 1, wherein the reclosable container is a reclosable pouch comprising (i) a first sidewall and a second sidewall, the first and second sidewalls opposing one another, and (ii) complementary interlocking closure elements disposed on the respective first and second opposing sidewalls.

15. The gastight valve strip of claim 14, wherein the first and second film layers are sealed to an interior surface of the first sidewall.

16. The gastight valve strip of claim 15, wherein the second film layer is sealed to the first sidewall by a first sidewall seal disposed at least across a first edge of the second film layer.

17. The gastight valve strip of claim 16, wherein the first film layer is further attached to the second film layer by a thermal seal disposed at least across a first edge of the first film layer.

18. The gastight valve strip of claim 17, wherein the second film layer is further sealed to the first sidewall by a second sidewall seal disposed at least across a second edge of the second film layer.

* * * * *